US011773465B2

(12) United States Patent
Mishra et al.

(10) Patent No.: US 11,773,465 B2
(45) Date of Patent: Oct. 3, 2023

(54) ULTRA-HIGH STRENGTH WEATHERING STEEL FOR HOT-STAMPING APPLICATIONS

(71) Applicant: NUCOR CORPORATION, Charlotte, NC (US)

(72) Inventors: Kishlay Mishra, Memphis, TN (US); Paul Kelly, Mount Kembla (AU); Tao Wang, Germantown, TN (US)

(73) Assignee: NUCOR CORPORATION, Charlotte, NC (US)

( * ) Notice: Subject to any disclaimer, the term of this patent is extended or adjusted under 35 U.S.C. 154(b) by 324 days.

(21) Appl. No.: 16/944,377

(22) Filed: Jul. 31, 2020

(65) Prior Publication Data

US 2021/0087650 A1 Mar. 25, 2021

Related U.S. Application Data

(60) Provisional application No. 62/902,825, filed on Sep. 19, 2019.

(51) Int. Cl.
*B21D 22/22* (2006.01)
*C21D 9/52* (2006.01)
(Continued)

(52) U.S. Cl.
CPC ..... *C21D 9/52* (2013.01); *B21D 22/022* (2013.01); *C21D 6/004* (2013.01); *C21D 6/005* (2013.01);
(Continued)

(58) Field of Classification Search
CPC ..... B21D 22/022; C21D 6/004; C21D 6/005; C21D 6/008; C21D 8/0205; C21D 8/0215;
(Continued)

(56) References Cited

U.S. PATENT DOCUMENTS 4,087,898 A 5/1978 Linne
4,437,902 A 3/1984 Pickens et al.
(Continued)

FOREIGN PATENT DOCUMENTS

CN 103302255 A 9/2013
CN 103305759 A 9/2013
(Continued)

OTHER PUBLICATIONS

Extended European Search Report for EP 19780857.9 dated Dec. 18, 2020, 7 pages.
(Continued)

*Primary Examiner* — Nicholas A Wang
*Assistant Examiner* — Maxwell Xavier Duffy
(74) *Attorney, Agent, or Firm* — Hahn Loeser & Parks LLP

(57) ABSTRACT

Disclosed herein is a light-gauge, ultra-high strength weathering steel sheet with a composition, material properties, and surface characteristics that make it suitable for hot-stamping applications and making hot-stamped products. Also disclosed herein is a high friction rolled carbon alloy steel strip free of prior austenite grain boundary depressions and having a smear pattern. Still further disclosed herein is a high friction rolled carbon alloy steel strip that has been surface homogenized to provide a thin cast steel strip free of a smear pattern.

43 Claims, 10 Drawing Sheets

(51) Int. Cl.

| | |
|---|---|
| ***C22C 38/46*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| ***C21D 8/02*** | (2006.01) |
| ***C21D 6/00*** | (2006.01) |
| ***C22C 38/48*** | (2006.01) |
| ***B21D 22/02*** | (2006.01) |
| ***C21D 9/48*** | (2006.01) |
| ***C21D 9/56*** | (2006.01) |

(52) U.S. Cl.

CPC ..... *C21D 6/008* (2013.01); *C21D 8/0205* (2013.01); *C21D 8/0215* (2013.01); *C21D 8/0226* (2013.01); *C21D 8/0263* (2013.01); *C21D 9/46* (2013.01); *C21D 9/48* (2013.01); *C21D 9/563* (2013.01); *C22C 38/002* (2013.01); *C22C 38/02* (2013.01); *C22C 38/04* (2013.01); *C22C 38/06* (2013.01); *C22C 38/42* (2013.01); *C22C 38/46* (2013.01); *C22C 38/48* (2013.01); *C21D 2211/002* (2013.01); *C21D 2211/008* (2013.01)

(58) Field of Classification Search

CPC ..... C21D 8/0226; C21D 2211/002; C21D 2211/008; C22C 38/02; C22C 38/04; C22C 38/42

See application file for complete search history.

(56) References Cited

U.S. PATENT DOCUMENTS

| | | | | |
|---|---|---|---|---|
| 4,676,844 | A | 6/1987 | Satoh et al. | |
| 5,105,638 | A * | 4/1992 | Mito | B21B 45/0251 72/187 |
| 5,508,119 | A | 4/1996 | Sheu et al. | |
| 5,636,543 | A | 6/1997 | Kajiwara et al. | |
| 5,666,837 | A | 9/1997 | Kajiwara et al. | |
| 6,187,117 | B1 | 2/2001 | Shen et al. | |
| 6,348,108 | B1 | 2/2002 | Yusa et al. | |
| 7,601,226 | B2 | 10/2009 | Voges et al. | |
| 8,062,095 | B2 | 11/2011 | Voges et al. | |
| 8,066,549 | B2 | 11/2011 | Voges et al. | |
| 8,074,331 | B2 | 12/2011 | Voges | |
| 8,128,460 | B2 | 3/2012 | Voges et al. | |
| 8,707,529 | B2 | 4/2014 | Voges | |
| 9,149,868 | B2 | 10/2015 | Williams et al. | |
| 9,333,625 | B1 | 5/2016 | Voges et al. | |
| 10,174,398 | B2 | 1/2019 | Watson et al. | |
| 2004/0016530 | A1 | 1/2004 | Schoen et al. | |
| 2008/0110592 | A1 | 5/2008 | Mao et al. | |
| 2008/0264525 | A1 | 10/2008 | Alwin | |
| 2010/0092331 | A1 | 4/2010 | Jeong et al. | |
| 2010/0186856 | A1 | 7/2010 | Williams et al. | |
| 2010/0258217 | A1 | 10/2010 | Kuehmann et al. | |
| 2010/0319814 | A1 | 12/2010 | Perez et al. | |
| 2011/0303386 | A1 | 12/2011 | Blejde et al. | |
| 2012/0216925 | A1* | 8/2012 | Kobayashi | C22C 38/02 148/330 |
| 2013/0126120 | A1 | 5/2013 | Nooning et al. | |
| 2014/0014238 | A1 | 1/2014 | Carpenter et al. | |
| 2014/0366602 | A1 | 12/2014 | Fang et al. | |
| 2014/0373981 | A1 | 12/2014 | Wang et al. | |
| 2015/0007913 | A1 | 1/2015 | Wang et al. | |
| 2015/0321232 | A1 | 11/2015 | Stewart et al. | |
| 2016/0177411 | A1* | 6/2016 | Watson | C22C 38/20 148/334 |
| 2017/0204487 | A1 | 7/2017 | Belchior | |
| 2017/0240992 | A1 | 8/2017 | Watson et al. | |
| 2019/0161817 | A1* | 5/2019 | Takenaka | C22C 38/60 |
| 2019/0169707 | A1* | 6/2019 | Hayashi | C22C 38/14 |
| 2019/0309383 | A1 | 10/2019 | Wang et al. | |
| 2020/0255927 | A1 | 8/2020 | Wang et al. | |
| 2020/0256029 | A1 | 8/2020 | Wang et al. | |

FOREIGN PATENT DOCUMENTS

| | | | |
|---|---|---|---|
| CN | 103305770 | A | 9/2013 |
| DE | 2809356 | A1 | 9/1979 |
| DE | 112013000747 | T5 | 12/2014 |
| DE | 112013001434 | T5 | 12/2014 |
| GB | 289812 | A | 10/1928 |
| JP | S53114762 | A | 10/1978 |
| JP | S56071502 | A | 6/1981 |
| JP | S57149010 | A | 9/1982 |
| JP | H02182302 | A | 7/1990 |
| JP | H03210903 | A | 9/1991 |
| JP | H05228516 | A | 9/1993 |
| JP | H09118950 | A | 5/1997 |
| JP | 10156413 | A | 6/1998 |
| JP | H10166011 | A | 6/1998 |
| JP | 2013208639 | A | 10/2013 |
| KR | 1020140009674 | A | 1/2014 |
| SU | 136612 | A1 | 11/1960 |
| SU | 1047557 | A1 | 10/1983 |
| SU | 1676694 | A1 | 9/1991 |
| WO | 2010094077 | A1 | 8/2010 |
| WO | 2013135095 | A1 | 9/2013 |
| WO | 2018157136 | A1 | 8/2018 |
| WO | 2020162983 | A1 | 8/2020 |
| WO | 2020163664 | A1 | 8/2020 |

OTHER PUBLICATIONS

PCT/US2020/044401 International Search Report and Written Opinion dated Nov. 20, 2020, 23 pages.

Extended European Search Report for EP 20864869.1 dated Jun. 24, 2022, 11 pages.

Orowan, E., "The Calculation of Roll Pressure in hot and Cold Flat Rolling" , Proc. Institute of Mechanical Engineers, (1943) vol. 150. pp. 140-167.

Sun, W., et al., "Friction in the roll bite under various hot rolling conditions" , In D. Hua, et al. (Eds), Symposium on Advanced Structural Steels and New Rolling Technologies, (2005) pp. 110-120. China: Northeastern University.

Azushima, A., et al., "Prediction of effect of rolling speed on coefficient of friction in hot sheet rolling of steel using sliding rolling tribo-simulator" , J. Mater. Process. Tech. (2009) doi: 10.1016/j.jmatprotec.2009.08.005, 6 pages.

Abdelraouf-Allam, TM. Direct Hot Rolled Dual Phase Weathering Steel. Dissertation for the Degree of Masters of Science, iEHK Steel Institute, Rwthaachen University, Nov. 26, 2015, 99 pages.

ASTM A606, Standard for Steel, Sheet and Strip, High-Strength, Low-Alloy, Hot-Rolled and Cold-Rolled, with Improved Atmospheric Corrosion Resistance, as downloaded from astm.org on Sep. 22, 2016, 4 pages.

ASTM G101, Standard Guide for Estimating the Atmospheric Corrosion Resistance of Low-Alloy Steels, as downloaded from astm.org on Sep. 22, 2016, 9 pages.

PCT/US2016/020205 International Search Report and Written Opinion dated May 6, 2016, 16 pages.

PCT/US2019/026036 International Search Report and Written Opinion dated Jul. 9, 2019, 7 pages.

PCT/US2019/052050 International Search Report and Written Opinion dated Jan. 7, 2020, 12 pages.

T. Misawa et al., "The Mechanism of Atmospheric Rusting and the Effect of Cu and P on the Rust Formation of Low Alloy Steels", Corrosion Science, 1971, vol. 11, pp. 35-48, Pergaman Press. Printed in Great Britain.

* cited by examiner

ULTRA-HIGH STRENGTH WEATHERING STEEL FOR HOT-STAMPING APPLICATIONS

This patent application claims priority to and benefit of U.S. Provisional Application No. 62/902,825, filed Sep. 19, 2019, which is incorporated herein by reference.

BACKGROUND AND SUMMARY

This invention relates to thin cast steel strips, methods for producing a thin cast steel strip suitable for hot-stamping, and steel products made therefrom and thereby.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

To obtain a desired thickness the thin steel strip may pass through a mill to hot roll the thin steel strip. While performing hot rolling, the thin steel strip is generally lubricated to reduce the roll bite friction, which in turn reduces the rolling load and roll wear, as well as providing a smoother surface finish. The lubrication is used to provide a low friction condition. A low friction condition is defined as one where the coefficient of friction (u) for the roll bite is less than 0.20. After hot rolling, the thin steel strip undergoes a cooling process. In a low friction condition, after undergoing a pickling or acid etching process to remove oxidation scale, large prior austenite grain boundary depressions have been observed on the hot rolled exterior surfaces of cooled thin steel strips. In particular, while the thin steel strips tested using dye penetrant techniques appeared defect free, after acid pickling of the same thin steel strips, the prior austenite grain boundaries are etched by the acid to form prior austenite grain boundary depressions. This etching may further cause a defect phenomenon to occur along the etched prior austenite grain boundaries and the resulting depressions. The resulting defects and separations, which are more generally referred to as separations, can extend at least 5 microns in depth, and in certain instances 5 to 10 microns in depth.

Also applicable to the present disclosure, weathering steels are typically high strength low alloy steels resistant to atmospheric corrosion. In the presence of moisture and air, low alloy steels oxidize at a rate that depends on the level of exposure to oxygen, moisture and atmospheric contaminants to the metal surface. When the steel oxidizes it can form an oxide layer commonly referred to as rust. As the oxidation process progresses, the oxide layer forms a barrier to the ingress of oxygen, moisture and contaminants, and the rate of rusting slows down. With weathering steel, the oxidation process is initiated in the same way, but the specific alloying elements in the steel produce a stable protective oxide layer that adheres to the base metal, and is much less porous than the oxide layer typically formed in a non-weathering steel.

The result is a much lower corrosion rate than would be found on ordinary, non-weathering structural steel.

Weathering steels are defined in ASTM A606, *Standard Specification for Steel, Sheet and Strip, High Strength, Low-Alloy, Hot Rolled and Cold Rolled with Improved Atmospheric Corrosion Resistance*. Weathering steels are supplied in two types: Type 2, which contains at least 0.20% copper based on cast or heat analysis (0.18% minimum Cu for product check); and Type 4, which contains additional alloying elements to provide a corrosion index of at least 6.0 as calculated by ASTM G101, *Standard Guide for Estimating the Atmospheric Corrosion Resistance of Low-Alloy Steels*, and provides a level of corrosion resistance substantially better than that of carbon steels with or without copper addition.

Prior to the present invention, weathering steels were typically limited to yield strengths of less than 700 MPa and tensile strengths of less than 1000 MPa. Also, prior to the present invention, the strength properties of weathering steels typically were achieved by age hardening. U.S. Pat. No. 10,174,398, incorporated herein by reference, is an example of a weathering steel achieved by age hardening.

Weathering steels have not previously been relied on for use in hot-stamping applications. Instead, steel sheets relied on for hot-stamping applications were of stainless-steel compositions or require an additional coating such as, for example, aluminum-silicon coating, zinc-aluminum coating, or the like. The coatings relied on in these steels are for (1) avoiding oxidation upon reheating; (2) providing corrosion protection during service life of the product; and/or (3) to reduce or eliminate decarburization at the surface. More generally stated, the composition and/or coatings of the prior art hot-stamping steel sheets are relied on maintain high-strength properties and favorable surface structure characteristics. Additionally, the prior art hot-stamping steel sheets also achieve their strength properties, or hardness, from a microstructure influenced by boron.

The present disclosure sets out to provide a light-gauge, ultra-high strength weathering steel that may be relied on for use in hot-stamping applications. Examples of the present disclosure provide a light-gauge, ultra-high strength weathering steel as an alternative to the previously relied on stainless-steel compositions, compositions requiring the additional coatings, and/or steels relying on the addition of boron for use in hot-stamping applications. Specifically, the present disclosure sets out to provide a light-gauge, ultra-high strength weathering steel that may be relied on for use in hot-stamping applications with high-strength properties, that may have favorable surface structure characteristics, that may eliminate boron to some degree (e.g. eliminate entirely, eliminate any purposeful additions of boron, or that possesses a reduced quantity of boron, etc.), that may achieve strength properties by way of a primarily or substantially bainitic microstructure, that may be processed with current stamping equipment, that is a weathering steel with a corrosion index of 6.0 or greater, and/or that may be provided with or without an additional coating, albeit a coating may be added for other properties beyond the baseline properties noted here.

In one set of examples, the present disclosure sets out to provide a light-gauge, ultra-high strength weathering steel formed by shifting of the peritectic point away from the carbon region and/or increasing a transition temperature of the peritectic point of the composition. Specifically, shifting the peritectic point away from the carbon region and/or increasing a transition temperature of the peritectic point of the composition appears to inhibit defects and results in a high strength martensitic steel sheet that is defect free. In the present example, the addition of nickel is relied on for this wherein the addition of nickel must be sufficient enough to shift the 'peritectic point' away from the carbon region that would otherwise be present in the same composition without the addition of nickel. Also disclosed are products produced from an ultra-high strength weathering steel being of various shapes, as additionally disclosed herein, and having improved strength properties that were not previously available. Also disclosed is an ultra-high strength weathering steel sheet suitable for hot-stamping applications and a method for producing hot-stamped products from an ultra-high strength weathering steel strip resulting from a slowly cooled variation of the high strength martensitic steel sheet noted herein. In examples, the ultra-high strength weathering steel sheet suitable for hot-stamping applications may comprise a bainitic microstructure and/or a martensitic microstructure.

In another set of examples, the present disclosure sets out to eliminate the prior austenite grain boundary depressions but maintain a smear pattern. In the present set of examples, the thin cast steel strip undergoes a high friction rolling condition where grain boundary depressions form a smear pattern at, at least, the surface of the thin cast steel strip. Specifically, the present example sets out to form the smear pattern of the prior austenite grain boundary depressions upon eliminating the prior austenite grain boundary depressions from the surface and improving the formability of the steel strip or steel product. By improving formability of the steel strip products being of various shapes, as additionally disclosed herein, and having improved strength properties that were not previously available. The present example is not only applied with the above-mentioned ultra-high strength weathering steel but may additionally be applied with martensitic steels, other weathering steels, steel strips which undergo hot-stamping applications, hot-stamping products produced from thin cast steel strips, and/or steel strips or products which exhibit prior austenite grain boundary depressions.

Still yet, in another set of examples, the present disclosure sets out to eliminate grain boundary depressions and smear patterns formed therefrom. In the present set of examples, the thin cast steel strip undergoes surface homogenization, thereby, eliminating the smear pattern. As a result, the thin cast steel strip has a surface not only free of prior-austenite grain boundary depressions but additionally free of the smear pattern produced as a result of the high friction rolling condition, to provide, in some examples, a thin cast steel strip surface having a surface roughness (Ra) that is not more than 2.5 μm. The present examples are not only applied with the above-mentioned ultra-high strength weathering steel but may additionally be applied with martensitic steels, other weathering steels, steel strips which undergo hot-stamping applications, hot-stamping products produced from thin cast steel strips, and/or steel strips or products which exhibit prior austenite grain boundary depressions.

Ultra-High Strength Weathering Steel for Use in Hot-Stamping Applications

Presently disclosed is a method for making a hot-stamped product from a light-gauge, ultra-high strength weathering steel sheet made by the steps comprising: (a) preparing a molten steel melt comprising: (i) by weight, between 0.20% and 0.35% carbon, between 0.1 and 3.0% chromium, between 0.7% and 2.0% manganese, between 0.10% and 0.50% silicon, between 0.1% and 1.0% copper, less than or equal to 0.12% niobium, less than 0.5% molybdenum, between 0.1% and 3.0% nickel, and silicon killed containing less than 0.01% aluminum, and (ii) the remainder iron and impurities resulting from melting; (b) forming the melt into a casting pool supported on casting surfaces of a pair of cooled casting rolls having a nip there between; (c) counter rotating the casting rolls and solidifying at a heat flux greater than 10.0 $MW/m^2$ into a steel sheet less than or equal to 2.5 mm in thickness and cooling the sheet in a non-oxidizing atmosphere to below 1100° C. and above Ara temperature at a cooling rate greater than 15° C./s before slowly cooling and/or before hot rolling, when hot rolled; and (d) slowly cooling the thin cast steel strip at less than 100° C./s to produce a microstructure of bainite or martensite from prior austenite within the thin cast steel strip and having a yield strength of between 620 and 1100 MPa, a tensile strength of between 650 and 1300 MPa, and an elongation of between 3% and 10%; and (e) hot-stamping the thin cast steel strip to form a product. Here and elsewhere in this disclosure elongation means total elongation. In an example, slowly cooling the thin cast steel strip at less than 100° C./s to produces a microstructure of primarily bainite from prior austenite within the thin cast steel strip and having a yield strength of between 620 and 800 MPa, a tensile strength of between 650 and 900 MPa, and an elongation of between 3% and 10%; In an example, the above thin cast steel strip may have between 1.0% and 3.0% nickel. In another example, the above thin cast steel strip may have between 2.0% and 3.0% nickel. In examples of the above the thin cast steel strip may have between 0.2% and 0.39% copper. In examples of the above, the thin cast steel strip may have between 0.1% and 1.0% chromium.

Slowly cooling the steel strip in the method above is being done as an alternative to rapidly cooling, or rapidly quenching, as described with respect the martensitic ultra-high strength weathering steel strip described elsewhere in the present disclosure. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite. In contrast, slowly cooling the steel strip or providing a slowly cooled steel strip, with the addition of nickel, chromium, and/or copper, the steel strip achieves up to more than 50% and, in some examples, more than 90% bainitic microstructure suitable for hot-stamping. In other examples, a slowly cooled steel strip may have a martensitic microstructure or a bainitic and martensitic microstructure as illustrated by specific examples below.

In both the rapidly cooled and slowly cooled microstructures, the addition of nickel must be sufficient enough to shift the 'peritectic point' away from the carbon region that would otherwise be present in the same composition without the addition of nickel. Specifically, the inclusion of nickel in the composition is believed to contribute to the shifting of the peritectic point away from the carbon region and/or increases a transition temperature of the peritectic point of the composition, which appears to inhibit defects and results in a high strength steel sheet that is defect free. In one example, the light-gauge, ultra-high strength weathering steel sheet may also be hot rolled to between 15% and 50% reduction before cooling. In another example, the desired properties may be achieved through nickel or nickel and copper, alone, and the above composition may comprise, by weight, between 0.1% and 1.0% chromium. When chromium is relied on, such as in the examples of between 0.1% and 3.0% chromium, the addition of chromium shifts the 'peritectic point' to the carbon region while the addition of nickel shifts the 'peritectic point' away from the carbon region. Thereby, an increased quantity of chromium requires a correspondingly increased quantity of nickel, or vice versa.

As noted above, copper may be additionally, or alternatively, be added to further improve the corrosion index in combination with, or as an alternative to, the nickel. Like nickel, copper may be relied on to shift the 'peritectic point' away from the carbon region when added, by weight percent, between 0.20% and 0.39%. Thereby, the copper quantity noted by the compositions recited herein may be modified by, weight percent, between 0.20% and 0.39% in an effort to support achieving a weathering steel having a corrosion index of 6.0 or greater in addition to the previously recited nickel quantity. Further, this addition of copper may be relied on as an alternative to nickel, thereby, the compositions recited herein may be modified with the addition of the aforementioned copper while additionally eliminating previously recited nickel. Stated differently, copper may be added in quantity levels higher than that found in scrap material in addition to or as an alternative to nickel to further assist in achieving a weathering steel having corrosion index of 6.0 or greater. Copper of the quantity in excess of 0.39% will have the opposite effect and will, instead, negatively impact the weathering characteristics when provided in excess of this quantity. Specific examples are provided in the detailed description illustrating this dynamic of the compositional characteristics in the ultra-high strength weathering steel disclosed herein. The corrosion index of 6.0 or greater of the thin cast steel strip is maintained through subsequent processing such as, for example, austenitizing, quenching upon austenitizing, batch annealing, hot-stamping, cold rolling, hot rolling, high friction rolling, shot blasting, surface homogenizing, oxidizing, coating, or the like.

Carbon levels in the present sheet steel are preferably not below 0.20% in order to inhibit peritectic cracking of the steel sheet. The addition of nickel is provided to further inhibit peritectic cracking of the steel sheet, but does so independent of relying on the carbon composition alone. The impact of nickel on the corrosion index is reflected in the following equation for determining the corrosion index calculation: $Cu*26.01+Ni*3.88+Cr*1.2+Si*1.49+P*17.28+Cu*Ni*7.29-Ni*P*9.1-Cu*Cu*33.39$ (where each element is a by weight percentage).

The molten melt may be solidified at a heat flux greater than 10.0 $MW/m^2$ into a steel sheet less than 2.5 mm in thickness, and the sheet may be cooled in a non-oxidizing atmosphere to below 1080° C. and above $Ar_3$ temperature at a cooling rate greater than 15° C./s before rapidly cooling, slowly cooling, and/or before hot rolling, when hot rolled and depending upon the variety of ultra-high strength weathering steel being pursued. A non-oxidizing atmosphere is an atmosphere typically of an inert gas such as nitrogen or argon, or a mixture thereof, which contains less than about 5% oxygen by weight. In another example, the sheet may be cooled in a non-oxidizing atmosphere to below 1100° C. and above $Ar_3$ temperature at a cooling rate greater than 15° C./s before rapidly cooling and/or before hot rolling, when hot rolled.

The steel sheet is slowly cooled to form a steel sheet with a microstructure having bainite or martensite, a yield strength of between 620 and 1100 MPa, a tensile strength of between 650 and 1300 MPa, and an elongation of between 3% and 10%. In an example, the steel sheet is slowly cooled to form a steel sheet with a microstructure having primarily bainite having a yield strength of between 620 and 800 MPa, a tensile strength of between 650 and 900 MPa, and an elongation of between 3% and 10%. In other examples, the steel sheet is slowly cooled to form a steel sheet with a microstructure having substantially bainite having a yield strength of between 620 and 800 MPa, a tensile strength of between 650 and 900 MPa, and an elongation of between 3% and 10%.

The method for making a hot-stamped product from a light-gauge, ultra-high strength weathering steel sheet may further comprise the step of austenitizing the thin cast steel strip at between 780° C. and 950° C. In other examples, the step of austenitizing may be performed between 850° C.-950° C., 900° C.-930° C., or 900° C.-950° C. The thin cast steel strip, prior to being austenitized, and/or the austenitized thin cast steel strip may further have a corrosion index of 6.0 or greater, independent of any additional protective coating. The step of austenitizing may be for a period of between 1 minute and 30 minutes. In another example, the step of austenitizing may be for a period of between 6 minutes and 10 minutes. Generally, the period for austenitizing is greatly reduced and/or the temperature for austenitizing is greatly reduced due to the carbon distribution of the ultra-high strength weathering steel sheet. The carbon distribution of the ultra-high strength weathering steel sheet is not otherwise found in prior hot-stamped steel compositions that require longer austenitizing periods. In view of this, and the reduced as-cast thickness, the microstructure for a thin cast steel strip is very suitable for a variety of heating technologies (e.g. hearth, infrared, induction, resistance, contact, or the like) relied on for austenitizing. Prior steel sheets relied on for hot-stamping applications that further comprise an additional coating for their properties either require increased heating durations or increased temperatures to further penetrate the coating during the step of austenitizing. Moreover, prior austenitized steel compositions are known to produce an undesirable surface having scales, or oxidation, not suitable for the surface characteristics or properties required in hot-stamping applications. Due to the composition, microstructure, the reduced austenitized temperature, and austenitized period of the thin cast steel strip of the present disclosure, the thin cast steel strip remains substantially free of scale after the step of austenitizing. Substantially free of scale, as used herein, refers to scale formation of less than 1.5 μm thick on the surface of the thin cast steel strip. Scale, as referred to herein, is oxidation or an oxidation layer formed during the austenitizing step. It is appreciated herein that oxidation may be provided on hot-stamped steels to provide a protective layer or as a coating. However, as emphasized in the present disclosure the ultra-high strength weathering steel is a material that possesses the necessary properties for use in hot-stamping applications without adding an oxidation layer or coating. The composition of the ultra-high strength weathering steel will provide resistance to oxidation during the austenitizing step of the hot-stamping application. It is also appreciated herein that oxidation layers or coatings may be added to the disclosed ultra-high strength weathering steel but this does not form a part of the discussion with respect to the material properties for a thin cast steel strip, and more specifically being substantially free of scale as a result of austenitizing, that is an ultra-high strength weathering steel for use as hot-stamping applications herein. In other words, because the thin cast steel strip remains substantially free of scale, or free of an oxidization layer, while maintaining weathering characteristics (e.g. a corrosion index of at least 6.0), a steel sheet suitable for hot-stamping application is provided independent of further surface treatment such as, for example, surface homogenization, shot blasting, coatings, or the like, albeit these additional treatments may be provided for alternative purposes as noted below.

The above methods for making a hot-stamped product from a light-gauge, ultra-high strength weathering steel sheet may further comprise the step of batch annealing the thin cast steel strip to reduce the strength properties and, thereby, the hardness of the thin cast steel strip. It has been found that the light-gauge, ultra-high strength weathering steel sheet with strength properties greater than prior hot-stamped steel compositions (e.g. 300-600 MPa) and, thereby, may increase the wear on the punching equipment used during metal stamping. A softer thin cast steel strip may be desired for such hot-stamping applications wherein this additional step of batch annealing may be undertaken to provide a reduction in the tensile strength and/or yield strength to these desired properties. Batch annealing facilitates bainite grain coarsening, iron-carbide formation and/or formation of softer ferrite phase to reduce the strength. In one example, batch annealing is performed to reduce the yield strength to below 600 MPa and to reduce the tensile strength to below 750 MPa. In one specific example, the tensile strength of a slowly cooled ultra-high strength weathering steel sheet was reduced from 815 MPa to 730 MPa and the yield strength decreased from 660 MPa to 450 MPa after batch annealing at 800° C. for 20 minutes while maintaining the weathering characteristics (e.g. corrosion index of at least 6.0, where the corrosion index is independent of any additional coating).

In some examples, the thin cast steel strip may be hot rolled to between 15% and 35% reduction before the step of cooling. In other examples, the steel sheet may be hot rolled to between 15% and 50% reduction before the step of cooling.

In some examples of the above, the thin cast steel strip may be high friction rolled. In one example, the thin cast steel strip may be high friction rolled to a reduced thickness of between 15% and 35% reduction before the step of cooling. In another example, the thin cast steel strip may be high friction rolled to between 15% and 50% reduction before the step of cooling. Stated differently, in some examples of the above, the thin cast steel strip may be high friction rolled before forming the bainite. In one example, the thin cast steel strip may be high friction rolled to a reduced thickness of between 15% and 35% reduction before forming the bainite. In another example, the thin cast steel strip may be high friction rolled to between 15% and 50% reduction before forming the bainite.

High friction rolling provides a pair of opposing exterior side surfaces of the thin cast steel strip that are primarily free of prior austenite grain boundaries. In another example, high friction rolling may provide a pair of opposing exterior side surfaces of the thin cast steel strip that are substantially free of prior austenite grain boundaries. In yet another example, high friction rolling may provide a pair of opposing exterior side surfaces of the thin cast steel strip that are free of prior austenite grain boundaries. The pair of opposing exterior side surface of the thin cast steel strip may further comprise a smear pattern formed from high friction hot rolling the prior austenite grain boundaries. The smear patterns may extend in the direction of rolling.

The molten steel used to produce the ultra-high strength weathering steel sheet is silicon killed (i.e., silicon deoxidized) comprising between 0.10% and 0.50% by weight silicon. The steel sheet may further comprise by weight less than 0.008% aluminum or less than 0.006% aluminum. The molten melt may have a free oxygen content between 5 to 70 ppm or between 5 to 60 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

In contrast to steel sheets typically relied on for hot-stamping applications and products, the above methods for making a hot-stamped product from a light-gauge, ultra-high strength weathering steel sheet is achieved in a thin cast steel strip with a composition having no purposeful addition of boron. In one example, the thin cast steel strip is formed with less than 5 ppm boron. The hot-stamped products from the above-mentioned light-gauge, ultra-high strength weathering steel sheet are further distinguished from prior hot-stamped steel materials and products such that it may be uncoated by a corrosion resistant coating typically found on prior hot-stamped steel materials and products. Alternatively, the hot-stamped products from the above-mentioned light-gauge, ultra-high strength weathering steel sheet may be coated by a corrosion resistant coating for further improved properties.

A light-gauge, ultra-high strength weathering sheet for use in hot-stamping applications may comprise a thin cast steel strip cast at a cast thickness less than or equal to 2.5 mm. The thin cast steel strip may have a composition comprising, by weight, between 0.20% and 0.40% carbon, between 0.1% and 3.0% chromium, between 0.7% and 2.0% manganese, between 0.10% and 0.50% silicon, between 0.1% and 1.0% copper, less than or equal to 0.12% niobium, less than 0.5% molybdenum, between 0.1% and 3.0% nickel, and silicon killed containing less than 0.01% aluminum, and the remainder iron and impurities resulting from melting. In other examples, the thin cast steel strip may have a composition as noted above with respect to the above method as well as the compositions described herein. In an example, the above thin cast steel strip may have between 1.0% and 3.0% nickel. In another example, the above thin cast steel strip may have between 2.0% and 3.0% nickel. In examples of the above the thin cast steel strip may have between 0.2% and 0.39% copper. In examples of the above, the thin cast steel strip may have between 0.1% and 1.0% chromium.

The light-gauge, ultra-high strength weathering steel for use in hot-stamping applications may have bainite formed from prior austenite. The bainite may be formed from the prior austenite within the thin cast steel strip by cooling the thin cast steel strip at less than 100° C./s. The microstructure of the thin cast steel strip may be bainite or martensite. In one example, the microstructure of the thin cast steel strip may be primarily baintite. In another example, the microstructure of the thin cast steel strip may be substantially bainite. The thin cast steel strip may further comprise a yield strength of between 620 and 800 MPa, a tensile strength of between 650 and 900 MPa, and an elongation of between 3% and 10%, or any other variation described with respect to the above method as well as described herein. The light-gauge, ultra-high strength weathering steel for use in hot-stamping applications may have a corrosion index of 6.0 or greater. The corrosion index of 6.0 or greater being independent of any additional coating.

The light-gauge, ultra-high strength weathering steel for use in hot-stamping applications may further undergo an austenitizing condition of between 780° C. and 950° C., or any other temperature range described with respect to the above method as well as described herein. The austenitizing condition may be for a period of between 1 minute and 30 minutes. In another example, the austenitizing condition may be for a period of between 6 minutes and 10 minutes. In some examples, the hot-stamped product formed from a light-gauge, ultra-high strength steel is free from scale with reheated to above an austenitizing temperature.

In some examples, the strength properties of the light-gauge, ultra-high strength weathering steel for use in hot-stamping applications may be reduced through batch annealing. Batch annealing facilitates bainite grain coarsening, iron-carbide formation, and/or formation of softer ferrite phase to reduce the strength. In one example, the tensile strength of a slowly cooled ultra-high strength weathering steel sheet was reduced from 815 MPa to 730 MPa and the yield strength decreased from 660 MPa to 450 MPa after batch annealing at 800° C. for 20 minutes while maintaining the weathering characteristics (e.g. corrosion index of at least 6.0 independent of any additional coating).

In some examples, the cast thickness of the thin cast steel strip may have a further reduced thickness of between 15% and 50% by hot rolling, or at a reduction described with respect to the above method as well as described herein. The hot rolling may be performed before cooling. In other words, the hot rolling may be performed before forming the bainite. The hot rolling may be high friction hot rolling. High friction hot rolling may provide a thin cast steel strip with a pair of opposing exterior side surfaces that are primarily, substantially, or free of prior austenite grain depressions. The pair of opposing exterior side surface may further comprise a smear pattern formed from the high friction hot rolled prior austenite grain boundaries. Further, the pair of opposing exterior side surfaces may be surface homogenized to remove, or eliminate, the smear patterns.

In examples of light-gauge, ultra-high strength weathering steel for use in hot-stamping applications, no purposeful additions of boron are added to the composition. In one example, the thin cast steel strip is formed with less than 5 ppm boron.

In some examples, the above light-gauge, ultra-high strength weathering steel for use in hot-stamping applications is uncoated with a corrosion resistant coating. In another example, the above hot-stamped product formed from a light-gauge, ultra-high strength weathering steel may be coated with a corrosion resistant coating.

BRIEF DESCRIPTION OF THE DRAWINGS

The invention may be more fully illustrated and explained with reference to the accompanying drawings in which.

DETAILED DESCRIPTION OF THE DRAWINGS

Figure 1:
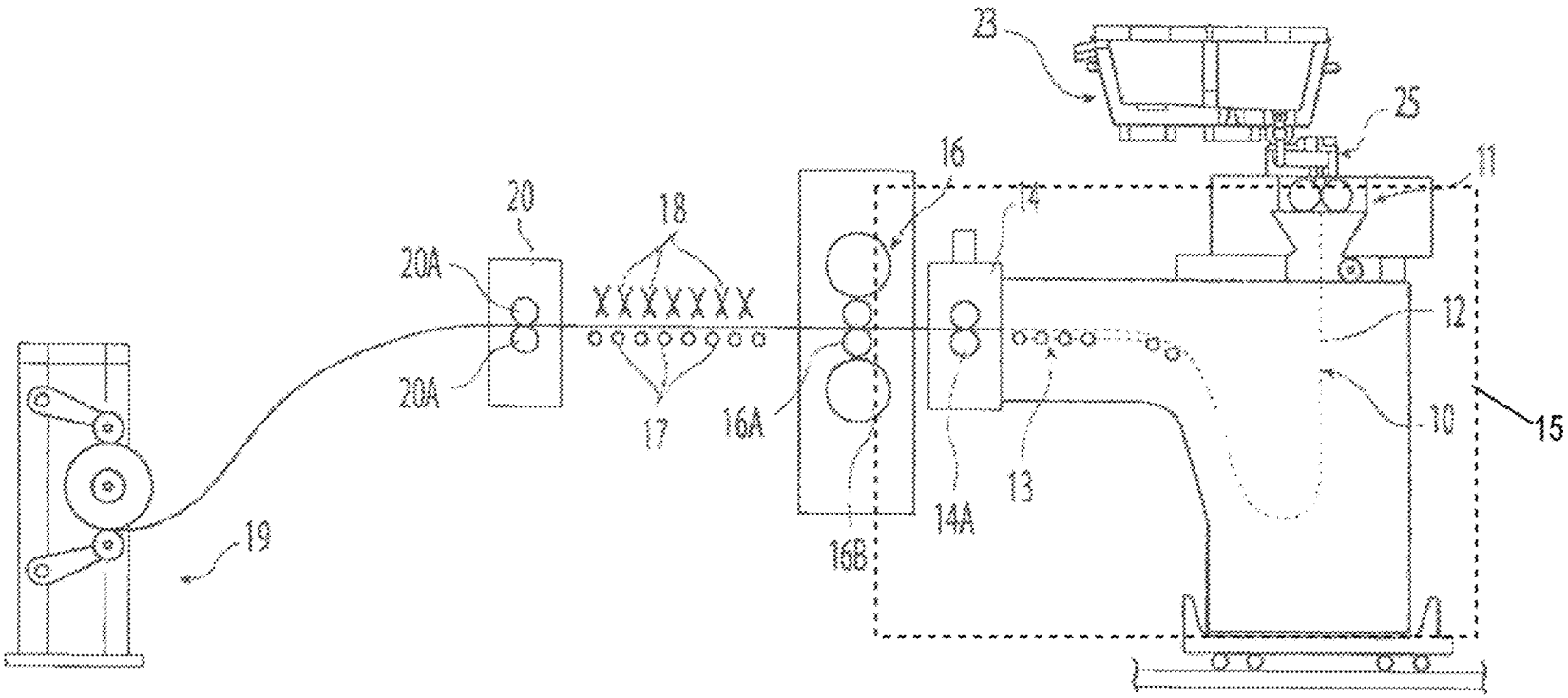
FIG. 1 illustrates a strip casting installation incorporating an in-line hot rolling mill and coiler.

Described herein, in one example, is a light-gauge, ultra-high strength weathering steel sheet. A light-gauge, ultra-high strength weathering steel sheet may be made from a molten melt. The molten melt may be processed through a twin roll caster. In one example, the light-gauge, ultra-high strength weathering steel sheet may be made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ producing a steel sheet less than 2.5 mm in thickness and cooling in a non-oxidizing atmosphere to below 1080° C. and above Ara temperature at a cooling rate greater than 15° C./s before rapidly cooling and/or before hot rolling, when hot rolled; and (c) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10%. In one example, the light-gauge, ultra-high strength weathering steel sheet may also be hot rolled to between 15% and 50% reduction before rapid cooling. The sheet may be cooled in a non-oxidizing atmosphere to below 1100° C. and above $Ar_3$ temperature at a cooling rate greater than 15° C./s before rapidly cooling and/or before hot rolling, when hot rolled. The $Ar_3$ temperature is the temperature at which austenite begins to transform to ferrite during cooling. In other words, the $Ar_3$ temperature is the point of austenite transformation. In each example, the inclusion of nickel shifts the peritectic point away from the carbon region and/or increases a transition temperature of the peritectic point of the composition of the steel sheet to provide a steel sheet that is defect free. The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

The above light-gauge, ultra-high strength weathering steel sheet may be relied on for hot-stamping applications by slowly cooling the above thin cast steel strip instead of rapidly cooling this thin cast steel strip. Specifically, the above ultra-high strength weather steel sheet may be relied on for hot-stamping applications upon slowly cooling the thin cast steel strip at less than 100° C./s to produce a microstructure of bainite or martensite from prior austenite within the thin cast steel strip and having a yield strength of between 620 and 1100 MPa, a tensile strength of between 650 and 1300 MPa, and an elongation of between 3% and 10%; and (e) hot-stamping the thin cast steel strip to form a product. In an example, the above ultra-high strength weather steel sheet may be relied on for hot-stamping applications upon slowly cooling the thin cast steel strip at less than 100° C./s to produce a microstructure of primarily bainite from prior austenite within the thin cast steel strip and having a yield strength of between 620 and 800 MPa, a tensile strength of between 650 and 900 MPa, and an elongation of between 3% and 10%. In another example, the above ultra-high strength weather steel sheet may be relied on for hot-stamping applications upon slowly cooling the thin cast steel strip at less than 100° C./s to produce a microstructure of substantially bainite from prior austenite within the thin cast steel strip and having a yield strength of between 620 and 800 MPa, a tensile strength of between 650 and 900 MPa, and an elongation of between 3% and 10%.

Additional modifications may be made to the above light-gauge, ultra-high strength weathering steel sheet to further improve the properties directed to hot-stamping applications. Specifically, the above composition may be modified to comprise, by weight, between 0.1 and 3.0% chromium and/or between 0.1 and 3.0% nickel having the hot-stamping properties noted in the preceding paragraph. Additional modifications and specific examples are further described with respect to hot-stamping applications below.

Also described herein are thin cast steel strips having hot rolled exterior side surfaces characterized as being primarily free, substantially free, or free of prior austenite grain boundary depressions but having smears, or elongated surface structures, such as in the examples of a high friction rolled high strength martensitic steel. Also described herein are methods or processes for producing same. These examples are not only applied with the above-mentioned ultra-high strength weathering steel but may additionally be applied with martensitic steels, other weathering steels, and/or steel strips or products which exhibit prior austenite grain boundary depressions.

Further described herein are thin steel strips having hot rolled exterior side surfaces characterized as being primarily free, substantially free, or free of prior austenite grain boundary depressions and free of smears, or elongated surface structures, such as in the examples of a high friction rolled high strength weathering steel. Also described herein are methods or processes for producing same. These examples are not only applied with the above-mentioned ultra-high strength weathering steel but may additionally be applied with martensitic steels, other weathering steels, and/or steel strips or products which exhibit prior austenite grain boundary depressions.

As used herein, primarily free means less than 50% of each opposing hot rolled exterior side surface contains prior austenite grain boundaries or prior austenite grain boundary depressions after acid etching (pickling). At least substantially free of all prior austenite grain boundaries or prior austenite grain boundary depressions means that 10% or less of each opposing hot rolled exterior side surface contains prior austenite grain boundary depressions or prior austenite grain boundary depressions after acid etching (pickling). Said depressions form etched grain boundary depressions after acid etching (also known as pickling) to render the prior austenite grain boundaries visible at 250× magnification. In other instances, free connotes that each opposing hot rolled exterior side surface is free, that is, completely devoid, of prior austenite grain boundary depressions, which includes being free of any prior austenite grain boundary depressions after acid etching. It is stressed that prior austenite grain boundaries may still exist within the material of the strip after hot rolling where the grain boundary depressions and separations on the surface have been removed by way of the techniques described described herein (e.g. where hot rolling occurs at a temperature above the Ara temperature using roll bite coefficients of friction equal to or greater than 0.20).

Figure 2:
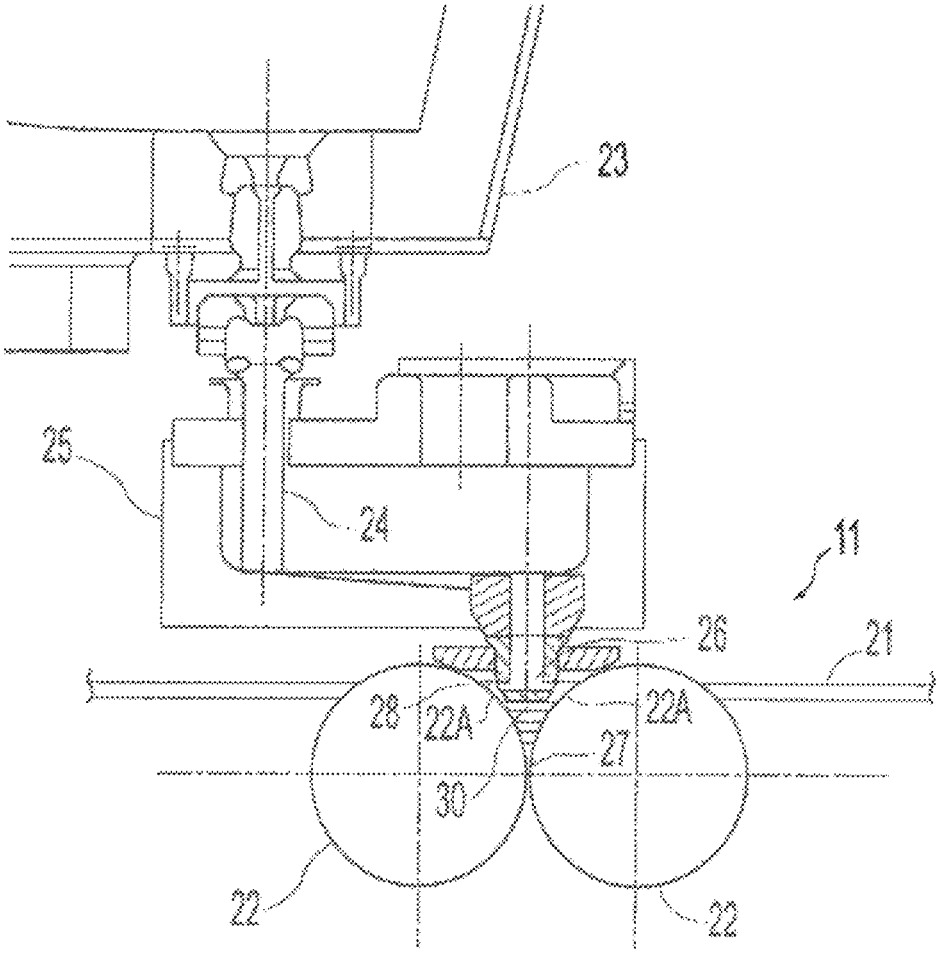
FIG. 2 illustrates details of the twin roll strip caster.

FIGS. 1 and 2 illustrate successive parts of strip caster for continuously casting steel strip, or steel sheet, of the present invention. A twin roll caster 11 may continuously produce a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of work rolls 16A and backing rolls 16B, where the cast strip is hot rolled to reduce a desired thickness. The hot rolled strip passes onto a run-out table 17 where the strip enters an intensive cooling section via water jets 18 (or other suitable means). The rolled and cooled strip then passes through a pinch roll stand 20 comprising a pair of pinch rolls 20A and then to a coiler 19.

As shown in FIG. 2, twin roll caster 11 comprises a main machine frame 21, which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the distributor or moveable tundish 25 through a metal delivery nozzle 26 between the casting rolls 22 above the nip 27. The molten metal delivered between the casting rolls 22 forms a casting pool 30 above the nip supported on the casting rolls. The casting pool 30 is restrained at the ends of the casting rolls by a pair of side closure dams or plates 28, which may be urged against the ends of the casting rolls by a pair of thrusters (not shown) including hydraulic cylinder units (not shown) connected to the side plate holders. The upper surface of casting pool 30 (generally referred to as the "meniscus" level) usually is above the lower end of the delivery nozzle so that the lower end of the delivery nozzle is immersed within the casting pool 30. Casting rolls 22 are internally water cooled so that shells solidify on the moving casting roll surfaces as they pass through the casting pool, and are brought together at the nip 27 between them to produce the cast strip 12, which is delivered downwardly from the nip between the casting rolls.

The twin roll caster may be of the kind that is illustrated and described in some detail in U.S. Pat. Nos. 5,184,668, 5,277,243, 5,488,988, and/or U.S. patent application Ser. No. 12/050,987, published as U.S. Publication No. 2009/0236068 A1. Reference is made to those patents and publications which are incorporated by reference for appropriate construction details of a twin roll caster that may be used in an example of the present invention.

After the thin steel strip is formed (cast) using any desired process, such as the strip casting process described above in conjunction with FIGS. 1 and 2, the strip may be hot rolled and cooled to form a desired thin steel strip having opposing hot rolled exterior side surfaces at least primarily free, substantially free, or free of prior austenite grain boundary depressions. As illustrated in FIG. 1, the in-line hot rolling mill 16 provides 15% to 50% reductions of strip from the caster. On the run-out-table 17, the cooling may include a water cooling section to control the cooling rates of the austenite transformation to achieve desired microstructure and material properties.

Figure 3:
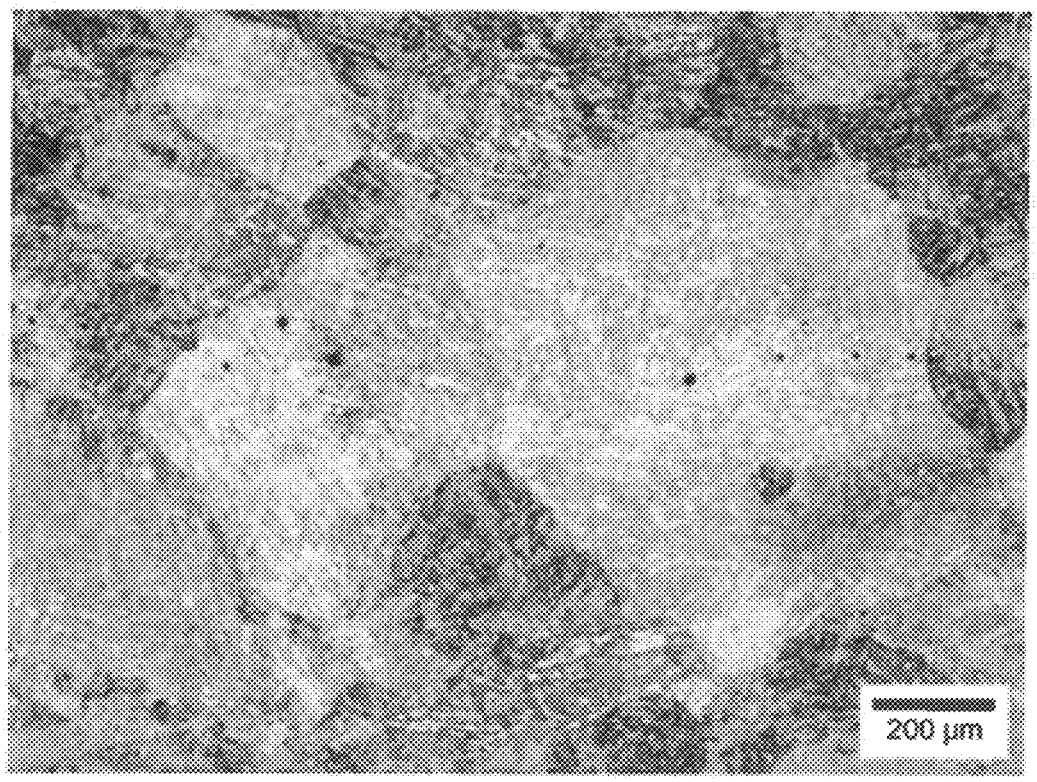
FIG. 3 is a micrograph of a steel sheet with a microstructure having at least 75% martensite.

FIG. 3 shows a micrograph of a steel sheet with a microstructure having at least 75% martensite from a prior austenite grain size of at least 100 μm. In some examples, the steel sheet is rapidly cooled to form a steel sheet with a microstructure having at least 90% by volume martensite or martensite and bainite. In another example, the steel sheet is rapidly cooled to form a steel sheet with a microstructure having at least 95% by volume martensite or martensite and bainite. In each of these examples, the steel sheet may additionally be hot rolled to between 15% and 50% reduction before rapid cooling.

Referring back to FIG. 1, a hot box 15 is illustrated. As shown by FIG. 1, after the strip has formed, it may pass into an environmentally controlled box, called a hot box 15, where it continues to passively cool before being hot rolled into its final gauge through a hot rolling mill 16. The environmentally controlled box, having a protective atmosphere, is maintained until entry into the hot rolling mill 16. Within the hot box, the strip is moved on the guide table 13 to the pinch roll stand 14. In examples of the present disclosure, undesirable thermal etching may occur in the hot box 15. Based upon whether thermal etching has occurred in the hot box the strip may be hot rolled under a high friction rolling condition based upon the parameters defined in greater detail below.

In particular instances, the methods of forming a thin steel strip further include hot rolling the thin steel strip using a pair of opposing work rolls generating a heightened coefficient of friction (p) sufficient to generate opposing hot rolled exterior side surfaces of the thin steel strip characterized as being primarily free substantially free, or free of prior austenite grain boundary depressions, and being characterized as having elongated surface structure associated with surface smear patterns formed under shear through plastic deformation. In certain instances, the pair of opposing work rolls generate a coefficient of friction (p) equal to or greater than 0.20 0.25, 0.268, or 0.27, each with or without use of lubrication at a temperature above the Ara temperature. It is appreciated that the coefficient of friction may be increased by increasing the surface roughness of the surfaces of the work rolls, eliminating the use of any lubrication, reducing the amount of lubrication used, and/or electing to use a particular type of lubrication. Other mechanisms for increasing the coefficient of friction as may be known to one of ordinary skill may also be employed—additionally or separately from the mechanisms previously described. The above process is referred to herein, generally, as high friction rolling.

As mentioned above, it is appreciated that high friction rolling may be achieved by increasing the surface roughness of the surfaces of one or more of the work rolls. This is referred to herein, generally, as work roll surface texturing. There are many ways to produce textured work rolls with one of those ways being, for example, Electrical Discharge Roll Texturing ("EDT"). The work roll surface texturing may be modified and measured by various parameters for use in a high friction rolling application. By example, the average roughness (Ra) of the profile of a work roll may provide a point of reference for generating the requisite coefficient of friction for the roll bite as noted in the examples above. To achieve high friction rolling by way of work roll surface texturing in one example newly ground and textured work rolls may have a Ra between of between 2.5 μm and 7.0 μm. Newly ground and textured work rolls are referred to herein more generally as new work rolls. In a specific example, new work roll(s) may have a Ra of between 3.18 μm and 4.0 μm. The average roughness of a new work roll may decrease during use, or upon wear. Therefore, used work roll(s) may also be relied on to produce the high friction rolling conditions noted above so long as the used work roll(s) have, in one example, a Ra of between 2.0 μm and 4.0 μm. In a specific example, used work roll(s) may have a Ra of between 1.74 μm and 3.0 μm while still achieving the high friction rolling conditions noted above.

Additionally, or alternatively, the average surface roughness depth (Rz) of the work roll profile may also be relied on as an identifier to achieve the high friction rolling conditions noted above. New work roll(s) may have a Rz of between 20 μm and 41 μm. In one specific example, new work roll(s) may have a Rz of between 21.90 μm and 28.32 μm. Used work roll(s) may be relied on for the high friction rolling conditions noted above in one example so long as they maintain a Rz of between 10 μm and 20 μm before being removed from service. In one specific example, used work roll(s) have a Rz of between 13.90 μm and 20.16 μm before being removed from service.

Still yet, the above parameters may be further defined by the average spacing between the peaks across the profile (Sm). New work rolls(s) relied on to produce the high friction rolling condition may comprise a Sm of between 90 μm and 150 μm. In one specific example, new work roll(s) relied on to produce the high friction rolling condition comprise a Sm of between 96 μm and 141 μm. Used work roll(s) may be relied on for the high friction rolling conditions noted above in one example so long as they maintain a Sm of between 115 μm and 165 μm.

Table 2, below illustrates measured test data for work roll surface texturing relied on to produce a high friction rolling condition, by position on the work roll, and further provides a comparison between the new work roll parameters and the used work roll parameters, before the used work roll is to be removed from service:

TABLE 2

| | | New Rolls | | | Used Rolls | | | Delta (Δ) | | |
|---|---|---|---|---|---|---|---|---|---|---|
| Roll | Position | Ra | Sm | Rz | Ra | Sm | Rz | Ra | Sm | Rz |
| Top Roll | OS Qtr* | 3.64 | 128 | 25.74 | 2.56 | 121 | 17.30 | | | |
| Top Roll | OS Qtr* | 3.88 | 125 | 24.44 | 3.02 | 128 | 17.64 | | | |
| Top Roll | OS Qtr* | 3.80 | 112 | 23.54 | 2.78 | 128 | 19.06 | | | |
| Top Roll | Avg OS Qtr* | 3.77 | 121.67 | 24.57 | 2.79 | 125.67 | 18.00 | 0.99 | −4.00 | 6.57 |
| Top Roll | Ctr** | 3.48 | 119 | 24.1 | 2.76 | 154 | 18.46 | | | |
| Top Roll | Ctr** | 3.44 | 112 | — | 2.36 | 134 | 17.46 | | | |
| Top Roll | Ctr** | 4.06 | 117 | 26.12 | 2.64 | 121 | 16.36 | | | |

TABLE 2-continued

| | | New Rolls | | | Used Rolls | | | Delta (Δ) | | |
|---|---|---|---|---|---|---|---|---|---|---|
| Roll | Position | Ra | Sm | Rz | Ra | Sm | Rz | Ra | Sm | Rz |
| Top Roll | Avg Ctr** | 3.66 | 116.00 | 25.11 | 2.59 | 136.33 | 17.43 | 1.07 | −20.33 | 7.68 |
| Top Roll | DS Qtr*** | 3.46 | 121 | 25.12 | 2.44 | 150 | 17.22 | | | |
| Top Roll | DS Qtr | 3.40 | 106 | 25.46 | 3.02 | 160 | 18.00 | | | |
| Top Roll | DS Qtr | 3.62 | 129 | 25.36 | 2.84 | 151 | 20.16 | | | |
| Top Roll | Avg DS Qtr | 3.49 | 118.67 | 25.31 | 2.77 | 153.67 | 18.46 | 0.73 | −35.00 | 6.85 |
| Top Roll | Overall Avg | 3.61 | 118.83 | 29.72 | 2.45 | 140.44 | 16.94 | | | |
| Bottom Roll | OS Qtr | 3.84 | 126 | 28.32 | 2.32 | 142 | 16.44 | | | |
| Bottom Roll | OS Qtr | 3.52 | 112 | 24.44 | 2.34 | 133 | 15.94 | | | |
| Bottom Roll | OS Qtr | 3.52 | 122 | 24.28 | 2.40 | 133 | 16.34 | | | |
| Bottom Roll | Avg OS Qtr | 3.63 | 120.00 | 25.68 | 2.35 | 136 | 16.24 | 1.27 | −16.00 | 9.44 |
| Bottom Roll | Ctr | 3.18 | 96 | 21.9 | 2.34 | 153 | 15.82 | | | |
| Bottom Roll | Ctr | 3.66 | 109 | 24.68 | 2.32 | 154 | 15.64 | | | |
| Bottom Roll | Ctr | 3.84 | 127 | 25.94 | 2.06 | 141 | 13.54 | | | |
| Bottom Roll | Avg Ctr | 3.56 | 110.67 | 24.17 | 2.24 | 149.33 | 15.00 | 1.32 | −38.67 | 9.17 |
| Bottom Roll | DS Qtr | 3.34 | 112 | 25.08 | 1.92 | 145 | 20.02 | | | |
| Bottom Roll | DS Qtr | 3.30 | 125 | 22.12 | 1.74 | 115 | 12.90 | | | |
| Bottom Roll | DS Qtr | 4.00 | 141 | 26.38 | 2.30 | 165 | 16.60 | | | |
| Bottom Roll | Avg DS Qtr | 3.55 | 126.00 | 24.53 | 1.99 | 141.67 | 16.51 | 1.56 | 15.67 | 8.02 |
| Bottom Roll | Overall Avg | 3.58 | 118.89 | 24.79 | 2.19 | 142.33 | 15.92 | | | |

*"OS Qtr" is the Operator Side Quarter area; and "Avg" is Average
**"Ctr" is Center of strip; and "Avg" is Average
***"DS Qtr" is the Drive Side Quarter area; and "Avg" is Average To determine whether high friction rolling is applicable for examples of the present disclosure may be dependent upon whether thermal etching has occurred in the hot box. Thermal etching is a byproduct, or consequence, of the casting process which exposes the prior austenite grain boundary depressions at the surface of steel strip. As indicated above, the prior austenite grain boundary depressions may be susceptible to causing the above mentioned defect phenomenon along etched prior austenite grain boundary depressions upon further acid etching. Specifically, thermal etching reveals prior austenite grain boundary depressions in a steel strip by formation of grooves in the intersections of the prior-austenite grain boundary depressions and the surface when the steel is exposed to a high temperature in an inert atmosphere, such as the hot box. These grooves make the prior austenite grain boundary depressions visible at the surface. Accordingly, examples of the present process identify high friction rolling as the step for producing the desired steel properties upon thermal etching in the hot box. Irrespective of the presence of thermal etching and evidence of prior austenite grain boundary depressions, high friction rolling may be provided to increase recrystallization of the thin steel strip.

Figure 5:
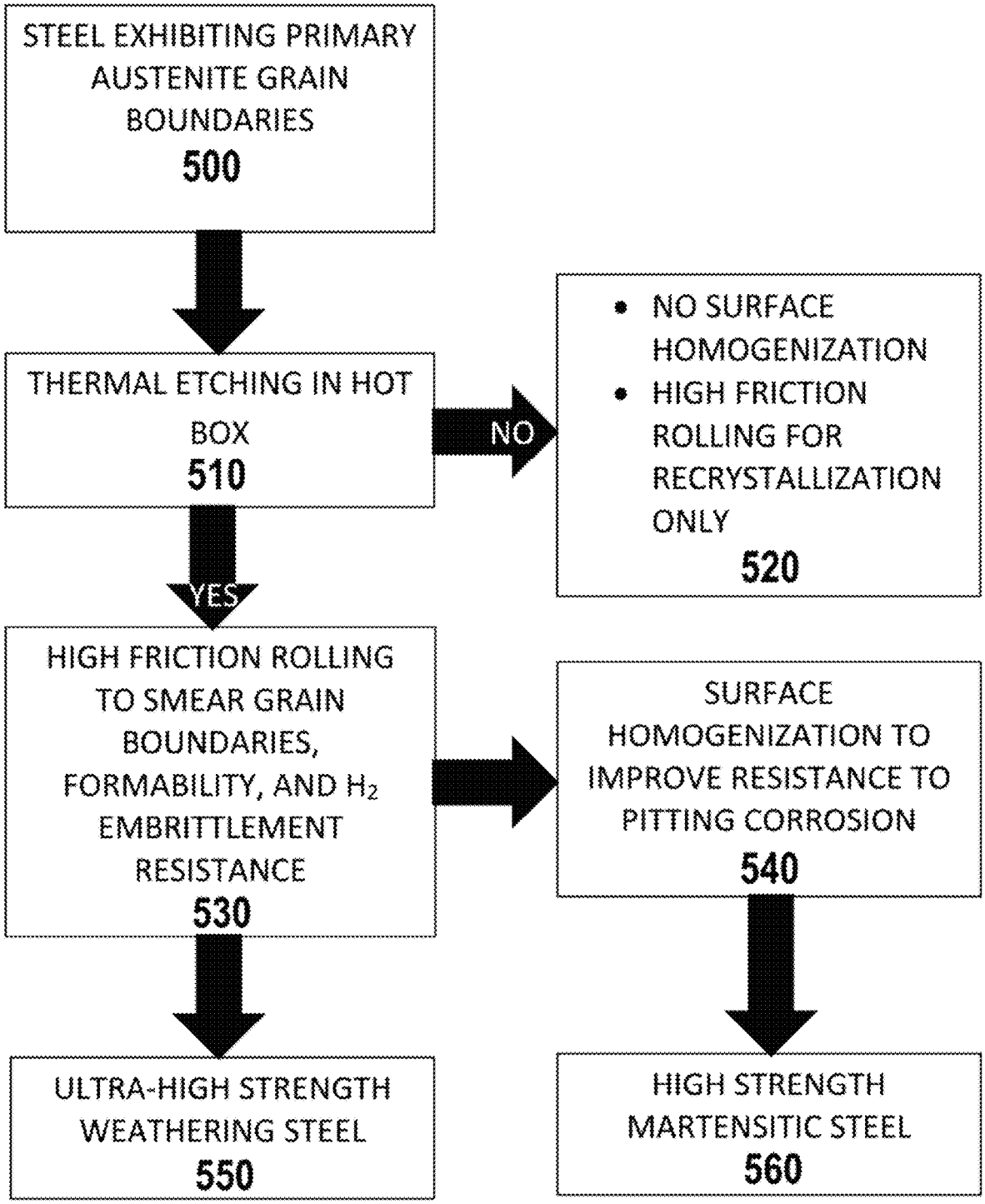
FIG. 5 is a flow diagram of processes according to one or more aspects of the present disclosure.

FIG. 5 is a flow diagram illustrating the process for applying high friction rolling and/or surface homogenization. In the present examples, to determine whether the steel strip or steel product is to undergo high friction rolling is dependent upon whether undesirable thermal etching has occurred in the hot box 510. If thermal etching has not occurred in the hot box high friction rolling is not necessary and is not undertaken to (1) smear the prior austenite grain boundary depressions, (2) increase formability of the steel product such as, for example, in an ultra-high strength weathering steel, and/or (3) improve hydrogen ($H_2$) embrittlement resistance. However, high friction rolling may still be pursued to achieve recrystallization 520 or to produce a microstructure as otherwise disclosed herein even if thermal etching has not occurred in the hot box. If thermal etching has occurred in the hot box 510 high friction rolling is performed 530 to (1) smear the prior austenite grain boundary depressions, (2) increase formability of a ultra-high strength weathering steel, and/or (3) improve hydrogen ($H_2$) embrittlement resistance by removing the prior austenite grain boundary depressions and eliminating weak spots which form as defects following a 120 hour corrosion test. In one example of the present disclosure, an ultra-high strength weathering steel 550, with a smear pattern, is produced. In another embodiment of the present disclosure, the smear pattern is removed, thereby improving resistance to pitting corrosion 540, such as that which is required in automotive applications. Such an embodiment produces, by example, a high strength martensitic steel 560. The smear pattern may be removed by way of a surface homogenization process. FIG. 5 additionally illustrates a surface homogenization process 540. Applicability of the surface homogenization process is discussed in greater detail below with respect to the present disclosure. Representative examples are also discussed in greater detail below.

Ultra-High Strength Weathering Steel

In some embodiments, a light-gauge, ultra-high strength weathering steel sheet may be made from a molten melt. The molten melt may be processed through a twin roll caster. In one example, the light-gauge, ultra-high strength weathering steel sheet may be made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ producing a steel sheet less than 2.5 mm in thickness and cooling in a non-oxidizing atmosphere to below 1080° C. and above $Ar_3$ temperature at a cooling rate greater than 15° C./s before rapidly cooling and/or before hot rolling, when hot rolled; and (c) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10%. In one example, the light-gauge, ultra-high strength weathering steel sheet may also be hot rolled to between 15% and 50% reduction before rapid cooling. The sheet may be cooled in a non-oxidizing atmosphere to below 1100° C. and above $Ar_3$ temperature at a cooling rate greater than 15° C./s before rapidly cooling and/or before hot rolling, when hot rolled. The $Ar_3$ temperature is the temperature at which austenite begins to transform to ferrite during cooling. In other words, the $Ar_3$ temperature is the point of austenite transformation. In each example, the inclusion of nickel shifts the peritectic point away from the carbon region and/or increases a transition temperature of the peritectic point of the composition of the steel sheet to provide a steel sheet that is defect free. The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Figure 4:
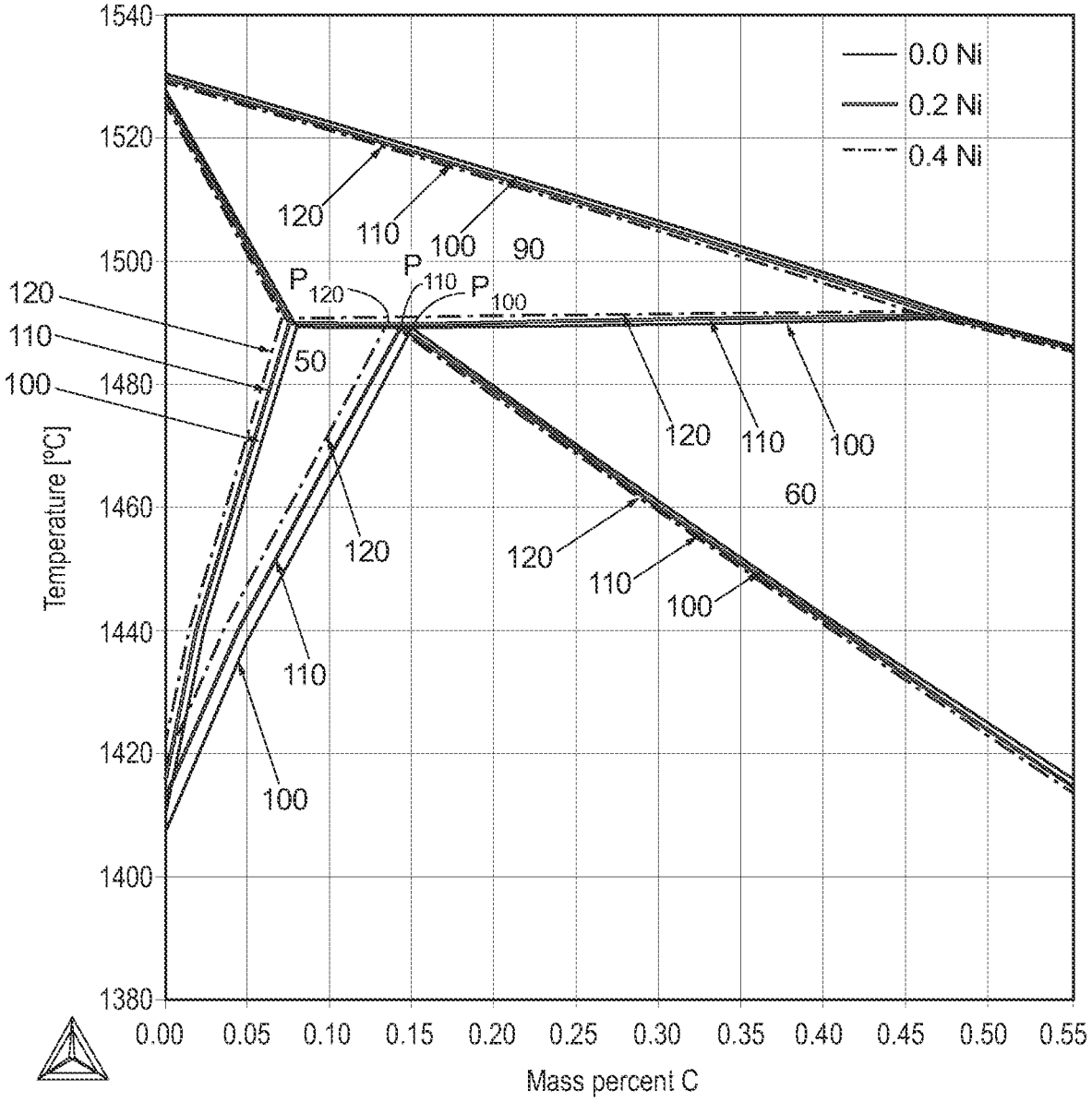
FIG. 4 is a phase diagram illustrating the effect of nickel to shift the peritectic point away from the carbon region.

The present steel sheet examples provide an addition of nickel to further prevent peritectic cracking while maintaining or improving hardenability. In particular, between 0.5% and 1.5%, by weight, nickel is added. The addition of nickel is believed to prevent the strip shell from buckling caused by the volume change in the peritectic region during phase transformation on the casting rolls and therefore enhances the even heat transfer during the strip solidification. It is believed that the addition of nickel shifts the peritectic point away from the carbon region and/or increases the transition temperature of the peritectic point of the composition to form a steel sheet that is defect free. The phase diagram of FIG. 4 illustrates this. In particular, the phase diagram of FIG. 4 illustrates the impact of each of 0.0%, by weight, nickel 100, 0.2%, by weight, nickel 110, and 0.4%, by weight, nickel 120. As illustrated by FIG. 4, the peritectic points $P_{100}$, $P_{110}$, and $P_{120}$, found at the intersection of the liquid+delta phase 90, the delta+gamma phase 50, and the liquid+gamma phase 60, is shifting a lower mass percent carbon (C) to a higher temperature as nickel is increased. The carbon content, otherwise, makes the steel strip susceptible to defects at lower temperatures in a steel strip having high yield strengths. The addition of nickel shifts the peritectic point away from the carbon region and/or increases the transition temperature of the peritectic point of the steel sheet to provide a defect free martensitic steel strip with high yield strengths.

The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Table 1, below, shows several compositional examples of a light-gauge, ultra-high strength weathering steel sheet of the present disclosure.

TABLE 1

| Example | | No. 1 | No. 2 | No. 3 | No. 4 |
|---|---|---|---|---|---|
| % Weight | C | 0.2272 | 0.2212 | 0.2835 | 0.2733 |
| | Mn | 0.91 | 0.94 | 0.91 | 1 |
| | Si | 0.22 | 0.2 | 0.21 | 0.2 |
| | S | 0.001 | 0.0006 | 0.0011 | 0.0018 |
| | P | 0.015 | 0.011 | 0.011 | 0.014 |
| | Cu | 0.34 | 0.16 | 0.19 | 0.32 |
| | Cr | 0.25 | 0.15 | 0.15 | 0.18 |
| | Ni | 0.66 | 0.75 | 1.01 | 0.78 |
| | V | 0.004 | 0.003 | 0.002 | 0.005 |
| | Nb | 0.002 | 0.002 | 0 | 0.004 |
| | Ca | 0 | 0.0001 | 0.0004 | 0 |
| | Al | 0.00008 | 0.0003 | 0.0016 | 0.0021 |
| | LecoN | 0.0066 | 0.0029 | 0.0039 | 0.0048 |
| | CEAWS | 0.54 | 0.507 | 0.585 | 0.592 |
| Mn/S | | 910 | 1567 | 827 | 556 |
| Mn/Si | | 4.1 | 4.7 | 4.3 | 5 |
| Corrosion index | | 6.71 | 6.01 | 6.84 | 6.77 |

In Table 1, LecoN is the measured, percent by weight, nitrogen ($N_2$) and CEAWS is the measured, percent by weight, carbon equivalent (CE).

Other elements relied on for hardenability produce the opposite effect by shifting the peritectic point closer the carbon region. Such elements include chromium and molybdenum which are relied on to increase hardenability but ultimately result in peritectic cracking. Through the addition of nickel, hardenability is improved and peritectic cracking is reduced to provide a fully quenched martensitic grade steel strip with high strength.

In the present compositions the addition of nickel may be combined with limited amounts of chromium and/or molybdenum, as described herein. As a result, nickel reduces any impact these hardening elements may have to produce peritectic cracking. In one example, however, the additional nickel would not be combined with a purposeful addition of boron. A purposeful addition is 5 ppm of boron, or more. In other words, in one example the addition of nickel would be used in combination with substantially no boron, or less than 5 ppm boron. Additionally, the light-gauge, ultra-high strength weathering steel sheet may be made by the further tempering the steel sheet at a temperature between 150° C. and 250° C. for between 2 and 6 hours. Tempering the steel sheet provides improved elongation with minimal loss in strength. For example, a steel sheet having a yield strength of 1250 MPa, tensile strength of 1600 MPa and an elongation of 2% was improved to a yield strength of 1250 MPa, tensile strength of 1525 MPa and an elongation of 5% following tempering as described herein.

The light-gauge, ultra-high strength weathering steel sheet may be silicon killed containing by weight less than 0.008% aluminum or less than 0.006% aluminum. The molten melt may have a free oxygen content between 5 to 70 ppm or between 5 to 60 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel sheet less than 2.5 mm in thickness, and cooled in a non-oxidizing atmosphere to below 1080° C. and above Ara temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel sheet may form from an austenite grain size of greater than 100 μm. In other embodiments, the martensite in the steel sheet may form from an austenite grain size of greater than 150 μm. Rapid solidification at heat fluxes greater than 10 $MW/m^2$ enables the production of an austenite grain size that is responsive to controlled cooling to enable the production of a defect free sheet.

The steel sheet additionally may be hot rolled to between 15% and 50% reduction and, thereafter, rapidly cooled to form a steel sheet with a microstructure having at least 75% martensite plus bainite, a yield strength of between 700 and 1600 MPa, a tensile strength of between 1000 and 2100 MPa and an elongation of between 1% and 10%. Further, the steel sheet may be hot rolled to between 15% and 35% reduction and, thereafter, rapidly cooled to form a steel sheet with a microstructure having at least 75% martensite plus bainite, a yield strength of between 700 and 1600 MPa, a tensile strength of between 1000 and 2100 MPa and an elongation of between 1% and 10%. In one example, the steel sheet is hot rolled to between 15% and 50% reduction and, thereafter, rapidly cooled to form a steel sheet with a microstructure having at least 90% by volume martensite or martensite and bainite. In still yet another example, the steel sheet is hot rolled to between 15% and 50% reduction and, thereafter, rapidly cooled to form a steel sheet with a microstructure having at least 95% by volume martensite or martensite and bainite.

Many products may be produced from the light-gauge, ultra-high strength weathering steel sheet of the type described herein. One example of a product that may be produced from a light-gauge, ultra-high strength weathering steel sheet includes a steel pile. In one example, a steel pile comprises a web and one or more flanges formed from the carbon alloy steel strip of the varieties described above. The steel pile may further comprise a length where the web and the one or more flanges extend the length. In use, the length of the steel pile is driven into the earth or soil to provide a structural foundation. The steel pile is driven into the earth or soil using a ram, such as a piston or hammer. The ram may be a part of and is, at least, driven by a pile driver. The ram strikes or impacts the steel pile forcing the steel pile into the earth or soil. Due to the impact, prior steel piles may buckle or become deformed under the impact of the ram. To avoid buckling, or damage, to prior steel piles the RPM or force of the pile driver is maintained below a damaging threshold. The present steel pile has illustrated an ability for an increase in the RPM or force being applied to the steel pile without buckling, or damaging, the steel pile, as reflected by the strength properties of the steel pile, comparatively to prior steel piles. Specifically, as tested, prior steel piles of comparable dimensional characteristics were driven and structurally failed wherein the steel pile of the present disclosure provide an increase of RPM of 25%. Moreover, the prior steel piles were additionally not weathering steel. Thereby, prior steel piles are susceptible to corrosion due to their placement in exterior conditions, including earth and soil conditions. Again, the present steel pile provides the necessary corrosion index for withstanding these conditions. The present strength properties and corrosion properties have not before been seen in combination for such a product.

One example of a steel pile is a steel pile comprising a web and one or more flanges formed from a carbon alloy steel strip having a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum where the carbon alloy steel strip has a microstructure having at least 75% by volume martensite or martensite plus bainite, a yield strength of between 700 and 1600 MPa, a tensile strength of between 1000 and 2100 MPa, an elongation of between 1% and 10%, and has a corrosion index of 6.0 or greater. In one example, the steel pile may be formed from a carbon alloy steel strip cast at a cast thickness less than or equal to 2.5 mm. In another example, the steel pile may be formed from a steel strip less than or equal to 2.0 mm. In still yet, another example, the steel pile may be formed from a steel sheet that is between 1.4 mm to 1.5 mm or of 1.4 mm or 1.5 mm in thickness. The steel piles may be channels, such as C-channels, box channels, double channels, or the like. The steel piles may, additionally or alternatively, be I-shaped members, angles, structural tees, hollow structural sections, double angles, S-shapes, tubes, or the like. Moreover, many of these members may be connected together, e.g. welded together, to form a single steel pile. It is appreciated herein, additional products may be made from a light-gauge, ultra-high strength weathering steel sheet. Additionally, it is appreciated herein, additional products may be made from an ultra-high strength weathering steel that is not produced through a twin roll caster but, instead, an ultra-high strength product may be produced through other methods.

Additional examples of an ultra-high strength weathering steel are provided below:

A light-gauge, ultra-high strength steel sheet comprising: a carbon alloy steel strip cast at a cast thickness less than or equal to 2.5 mm having a composition comprising:

(i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting;

wherein in the composition the inclusion of nickel shifts a peritectic point away from the carbon region and/or increases a transition temperature of the peritectic point to form the carbon alloy steel strip having a microstructure having at least 75% by volume martensite or martensite plus bainite, a yield strength of between 700 and 1600 MPa, a tensile strength of between 1000 and 2100 MPa and an elongation of between 1% and 10% that is defect free.

In an example of the above, the light-gauge, ultra-high strength steel sheet has a microstructure having at least 75% by volume martensite. In another example of the above, the light-gauge, ultra-high strength steel sheet has a microstructure having at least 90% by volume martensite. In yet another example of the above, the light-gauge, ultra-high strength steel sheet has a microstructure having at least 95% martensite.

In an example of the above, the light-gauge, ultra-high strength steel sheet comprises less than 5 ppm boron.

In an example of the above, the light-gauge, ultra-high strength steel sheet comprises between 0.05% and 0.12% niobium.

In an example of the above, the martensite in the steel sheet comes from an austenite grain size of greater than 100 μm.

In an example of the above, the martensite in the steel sheet comes from an austenite grain size of greater than 150 μm.

In an example of the above, the steel sheet may additionally be hot rolled to between 15% and 50% reduction before rapidly cooling.

In an example of the above, the carbon alloy steel sheet is hot rolled to a hot roll thickness of between a 15% and 35% reduction of the cast thickness before rapidly cooling.

In an example of the above, the steel sheet is a weathering steel having a corrosion index of 6.0 or greater.

A method of making a light-gauge, ultra-high strength weathering steel sheet comprising the steps of:

(a) preparing a molten steel melt comprising:
  (i) by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, silicon killed with less than 0.01% aluminum, and
  (ii) the remainder iron and impurities resulting from melting;
(b) forming the melt into a casting pool supported on casting surfaces of a pair of cooled casting rolls having a nip there between;
(c) counter rotating the casting rolls and solidifying at a heat flux greater than 10.0 MW/m2 the molten melt into a steel sheet to less than 2.5 mm in thickness delivered downwardly from the nip and cooling the sheet in a non-oxidizing atmosphere to below 1100° C. and above the $Ar_3$ temperature at a cooling rate greater than 15° C./s; and
(d) rapidly cooling to form a steel sheet with a microstructure having at least 75% by volume martensite or martensite plus bainite, a yield strength of between 700 and 1600 MPa, a tensile strength of between 1000 and 2100 MPa and an elongation of between 1% and 10% wherein the inclusion of nickel shifts the peritectic point away from the carbon region and/or increases a transition temperature of the peritectic point for inhibiting crack, or defect, formation in a high strength martensitic steel sheet.

In an example of the above, the microstructure has at least 75% by volume martensite. In another example of the above, the microstructure has at least 90% by volume martensite. In yet another example of the above, the microstructure has at least 95% by volume martensite.

In an example of the above, the carbon alloy steel sheet is formed with less than 5 ppm boron.

In an example of the above, the carbon alloy steel sheet comprises between 0.05% and 0.12% niobium.

In an example of the above, the martensite in the steel sheet comes from an austenite grain size of greater than 100 μm.

In an example of the above, the martensite in the steel sheet comes from an austenite grain size of greater than 150 μm.

In an example of the above, the steel sheet is hot rolled to a hot roll thickness of between a 15% and 50% reduction of the cast thickness before rapidly cooling.

In an example of the above, the steel sheet is hot rolled to a hot roll thickness of between a 15% and 35% reduction of the cast thickness before rapidly cooling.

In an example of the above, the high strength steel sheet is defect free.

Also disclosed is a steel pile comprising a web and one or more flanges formed from a carbon alloy steel sheet cast at a cast thickness less than or equal to 2.5 mm having a composition comprising, by weight, between 0.20% and 0.35% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum where the carbon alloy steel sheet has a microstructure having at least 75% by volume martensite or martensite plus bainite, a yield strength of between 700 and 1600 MPa, a tensile strength of between 1000 and 2100 MPa, an elongation of between 1% and 10% and is defect free.

In an example of the above, the light-gauge, ultra-high strength steel sheet has a microstructure having at least 75% by volume martensite. In another example of the above, the light-gauge, ultra-high strength steel sheet has a microstructure having at least 90% by volume martensite. In yet another example of the above, the light-gauge, ultra-high strength steel sheet has a microstructure having at least 95% martensite.

In an example of the above, the carbon alloy steel sheet of the steel pile comprises less than 5 ppm boron.

In an example of the above, the carbon alloy steel sheet of the steel pile comprises between 0.05% and 0.12% niobium.

In an example of the above, the martensite in the steel pile comes from an austenite grain size of greater than 100 μm.

In an example of the above, the martensite in the steel pile comes from an austenite grain size of greater than 150 μm.

In an example of the above, the steel sheet may additionally be hot rolled to between 15% and 50% reduction before rapidly cooling.

In an example of the above, the carbon alloy steel sheet is hot rolled to a hot roll thickness of between a 15% and 35% reduction of the cast thickness before rapidly cooling.

In an example of the above, the carbon alloy steel sheet is a weathering steel having a corrosion index of 6.0 or greater.

High Friction Rolled High Strength Weathering Steel

In the following examples, a high friction rolled high strength weathering steel sheet is disclosed. An example of an ultra-high strength weathering steel sheet is made by the steps comprising: (a) preparing a molten steel melt comprising: (i) by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above Ara temperature at a cooling rate greater than 15° C./s before rapidly cooling; (c) high friction rolling the thin cast steel strip to a hot rolled thickness of between a 15% and 50% reduction of the as cast thickness producing a hot rolled steel strip primarily free, substantially free, or free of prior austenite grain boundary depressions and having a smear pattern; and (d) rapidly cooling to form a steel sheet with a microstructure having by volume at least 75% martensite or at least 75% martensite plus bainite, a yield strength of between 700 and 1600 MPa, a tensile strength of between 1000 and 2100 MPa and an elongation of between 1% and 10%. Here and elsewhere in this disclosure elongation means total elongation. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite or at least 95% martensite plus bainite. The addition of nickel must be sufficient enough to shift the 'peritectic point' away from the carbon region that would otherwise be present in the same composition without the addition of nickel. Specifically, the inclusion of nickel in the composition is believed to contribute to the shifting of the peritectic point away from the carbon region and/or increases a transition temperature of the peritectic point of the composition, which appears to inhibit defects and results in an ultra-high strength weathering steel sheet that is defect free.

High friction rolling an ultra-high strength weathering steel further improves the formability of the ultra-high strength weathering steel. A measure for formability is set forth by the ASTM A370 bend tests standard. In embodiments, the ultra-high strength weathering steel of the present disclosure will pass a 3T 180 degree bend test and will do so consistently. In particular, the high friction rolling generates smears from the prior austenite grain boundary depressions under shear through plastic deformation. These elongated surface structures, characterized as the smear pattern, are desirous for the properties of an ultra-high strength weathering steel. Specifically, the formability of the ultra-high strength weathering steel is improved by the smear pattern.

The steel strip may further comprise by weight greater than 0.005% niobium or greater than 0.01% or 0.02% niobium. The steel strip may comprise by weight greater than 0.05% molybdenum or greater than 0.1% or 0.2% molybdenum. The steel strip may be silicon killed containing by weight less than 0.008% aluminum or less than 0.006% aluminum. The molten melt may have a free oxygen content between 5 to 70 ppm. The steel strip may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel strip less than 2.5 mm in thickness, and cooled in a non-oxidizing atmosphere to below 1080° C. and above Ara temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel strip may come from an austenite grain size of greater than 100 μm. In other embodiments, the martensite in the steel strip may come from an austenite grain size of greater than 150 μm. Rapid solidification at heat fluxes greater than 10 $MW/m^2$ enables the production of an austenite grain size that is responsive to controlled cooling after subsequent hot rolling to enable the production of defect free strip.

As indicated above, the steel strip of the present set of examples may comprise a microstructure having martensite or martensite plus bainite. Martensite is formed in carbon steels by the rapid cooling, or quenching, of austenite. Austenite has a particular crystalline structure known as face-centered cubic (FCC). If allowed to cool naturally, austenite turns into ferrite and cementite. However, when the austenite is rapidly cooled, or quenched, the face-centered cubic austenite transforms to a highly strained body-centered tetragonal (BCT) form of ferrite that is supersaturated with carbon. The shear deformations that result produce large numbers of dislocations, which is a primary strengthening mechanism of steels. The martensitic reaction begins during cooling when the austenite reaches the martensite start temperature and the parent austenite becomes thermodynamically unstable. As the sample is quenched, an increasingly large percentage of the austenite transforms to martensite until the lower transformation temperature is reached, at which time the transformation is completed.

Martensitic steels, however, are susceptible to producing the large prior austenite grain boundary depressions observed on the hot rolled exterior surfaces of cooled thin steel strips formed of low friction condition rolled steel. The step of acid pickling or etching amplifies these imperfections resulting in defects and separations. High friction rolling is now introduced as an alternative to overcome the problems identified for a low friction condition rolled martensitic steel. High friction rolling produces a smeared boundary pattern. Smeared boundary patterns may more generally be referred to herein as smear patterns. Additionally, smeared boundary patterns may alternatively be descriptively referred to as fish scale patterns.

Just as the ultra-high strength weathering steel above is relied on to produce product shapes and configurations such as the piles described above many products may be produced from a high friction rolled high strength weathering steel sheet of the type described herein. Like above, one example of a product that may be produced from a high friction rolled high strength weathering steel sheet includes a steel pile. In one example, a steel pile comprises a web and one or more flanges formed from the carbon alloy steel strip of the varieties described above. The steel pile may further comprise a length where the web and the one or more flanges extend the length. In use, the length of the steel pile is driven into the earth or soil to provide a structural foundation. The steel pile is driven into the earth or soil using a ram, such as a piston or hammer. The ram may be a part of and is, at least, driven by a pile driver. The ram strikes or impacts the steel pile forcing the steel pile into the earth or soil. Due to the impact, prior steel piles may buckle or become deformed under the impact of the ram. To avoid buckling, or damage, to prior steel piles the RPM or force of the pile driver is maintained below a damaging threshold. The present steel pile has illustrated an ability for an increase in the RPM or force being applied to the steel pile without buckling, or damaging, the steel pile, as reflected by the strength properties of the steel pile, comparatively to prior steel piles. Specifically, as tested, prior steel piles of comparable dimensional characteristics were driven and structurally failed wherein the steel pile of the present disclosure provide an increase of RPM of 25%. Moreover, the prior steel piles were additionally not weathering steel. Thereby, prior steel piles are susceptible to corrosion due to their placement in exterior conditions, including earth and soil conditions. Again, the present steel pile provides the necessary corrosion index for withstanding these conditions. The present strength properties and corrosion properties have not before been seen in combination for such a product.

In one example, the steel pile may be formed from a carbon alloy steel strip cast of the present examples at a cast thickness less than or equal to 2.5 mm. In another example, the steel pile may be formed from a steel strip of the present examples less than or equal to 2.0 mm. In still yet, another example, the steel pile may be formed from a steel sheet of the present examples that is between 1.4 mm to 1.5 mm or of 1.4 mm or 1.5 mm in thickness. The steel piles may be channels, such as C-channels, box channels, double channels, or the like. The steel piles may, additionally or alternatively, be I-shaped members, angles, structural tees, hollow structural sections, double angles, S-shapes, tubes, or the like. Moreover, many of these members may be connected together, e.g. welded together, to form a single steel pile. It is appreciated herein, additional products may be made from a high friction rolled ultra-high strength weathering steel sheet.

High Friction Rolled High Strength Martensitic Steel

In embodiments of the present disclosure, a high strength martensitic steel sheet is also disclosed. The high strength martensitic steel sheet examples that follow may additionally comprise weathering characteristics. Thereby, the high strength martensitic steel sheet examples herein may also be referred to as an ultra-high strength weathering steel sheet for such properties. Martensitic steels are increasingly being used in applications that require high strength, for example, in the automotive industry. Martensitic steel provides the strength necessary by the automotive industry while decreasing energy consumption and improving fuel economy. Martensite is formed in carbon steels by the rapid cooling, or quenching, of austenite. Austenite has a particular crystalline structure known as face-centered cubic (FCC). If allowed to cool naturally, austenite turns into ferrite and cementite. However, when the austenite is rapidly cooled, or quenched, the face-centered cubic austenite transforms to a highly strained body-centered tetragonal (BCT) form of ferrite that is supersaturated with carbon. The shear deformations that result produce large numbers of dislocations, which is a primary strengthening mechanism of steels. The martensitic reaction begins during cooling when the austenite reaches the martensite start temperature and the parent austenite becomes thermodynamically unstable. As the sample is quenched, an increasingly large percentage of the austenite transforms to martensite until the lower transformation temperature is reached, at which time the transformation is completed.

Martensitic steels, however, are susceptible to producing the large prior austenite grain boundary depressions observed on the hot rolled exterior surfaces of cooled thin steel strips formed of low friction condition rolled steel. The step of acid pickling or etching amplifies these imperfections resulting in defects and separations. High friction rolling is now introduced as an alternative to overcome the problems identified for a low friction condition rolled martensitic steel, however, high friction rolling has also been observed to produce an undesirable surface finish. In particular, high friction rolling produces smeared boundary pattern in combination with an uneven surface finish. Smeared boundary patterns may more generally be referred to herein as smear patterns. Additionally, smeared boundary patterns may alternatively be descriptively referred to as fish scale patterns. The uneven surface finish, having the smear patterns, then becomes susceptible to trapping acid and/or causing excessive corrosion, such as when the thin steel strip undergoes subsequent acid etching, thereby, resulting in excessive amounts of pitting. In view of this, for some steel strips or products, such as a martensitic steel sheet for use in an automotive application, additional surface treatment is warranted to provide a surface where the smear patterns and/or uneven surface finishes are removed from the surface.

To reduce or eliminate the smear pattern, and/or the uneven surface finish, the thin steel strip undergoes a surface homogenization process after the hot rolling mill. Examples of a surface homogenization process include abrasive blasting such as, for example, through use of an abrasive wheel, shot blasting, sand blasting, wet abrasive blasting, other pressurized application of an abrasive, or the like. One specific example of a surface homogenization process includes an eco-pickled surface (referred herein as "EPS"). Other examples of a surface homogenization process include the forceful application of an abrasive media onto the surface of the steel strip for homogenizing the surface of the steel strip. A pressurized component may also be relied on for the forceful application. By example, a fluid may propel an abrasive media. A fluid, as used herein, includes liquid and air. Additionally, or alternatively, a mechanical device may provide the forceful application. The surface homogenization process occurs after the thin cast steel strip reaches room temperature. In other words, the surface homogenization process does not occur in an in-line process with the hot rolling mill. The surface homogenization process may occur at a location separate from, or off-line from, the hot rolling mill and/or the twin cast rollers. In some examples, the surface homogenization process may occur after coiling.

Figure 7:
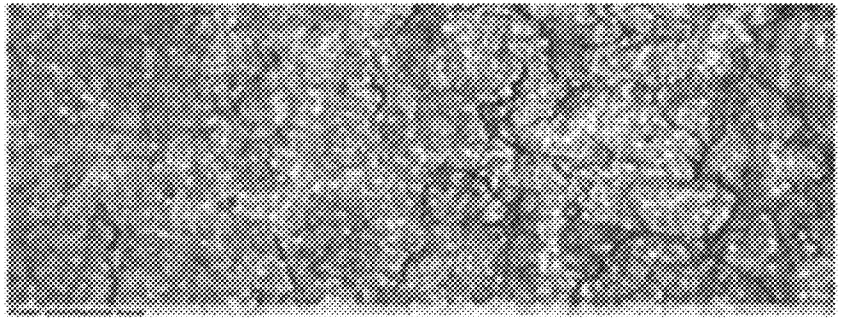
FIG. 7 is an image showing a high friction condition hot rolled steel strip surface having a smear pattern that has not been homogenized.
Figure 6:
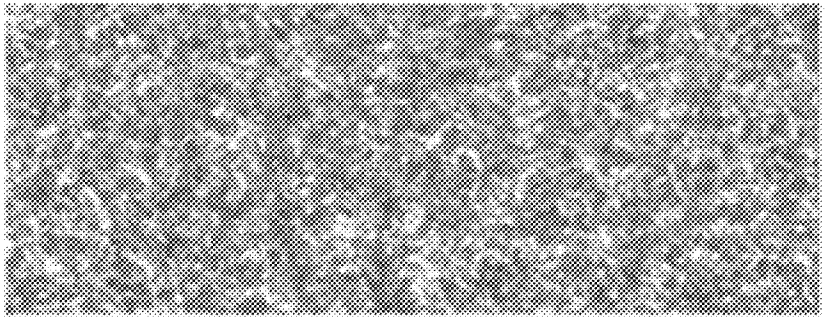
FIG. 6 is an image showing a high friction condition hot rolled steel strip surface following a surface homogenization process.

As used herein, the surface homogenization process alters the surface to be free of a smear pattern or eliminates the smear pattern. A surface of a thin steel strip that is free of a smear pattern or wherein the smear pattern has been eliminated is a surface that passes a 120 hour corrosion test without any surface pitting corrosion. Test samples which did not undergo a surface homogenization process fractured after 24 hours during a 120 hour corrosion test due to surface corrosion. FIG. 6 is an image showing a high friction hot rolled steel strip surface homogenized using EPS. Comparatively, FIG. 7 is an image showing a high friction hot rolled steel strip surface having a smear pattern that has not undergone a surface homogenization process. As indicated above, the smear pattern, unless it is removed by the surface homogenization process, may trap acid upon acid etching and, thereby, be susceptible to excessive pitting and/or corrosion. In summary and as used herein, a surface that has undergone surface homogenization is a surface which is free of the smear pattern previously formed by a high friction rolling condition.

After hot rolling, the hot rolled thin steel strip is cooled. In each of the embodiments, the steel strip undergoes the surface homogenization process after cooling. It is appreciated that cooling may be accomplished by any known manner. In certain instances, when cooling the thin steel strip, the thin steel strip is cooled to a temperature equal to or less than a martensite start transformation temperature $M_S$ to thereby form martensite from prior austenite within the thin steel strip.

An embodiment of a high strength martensitic steel sheet is made by the steps comprising: (a) preparing a molten steel melt comprising: (i) by weight, between 0.20% and 0.40% carbon, less than 1.0% chromium, between 0.7% and 2.0% manganese, between 0.10% and 0.50% silicon, between 0.1% and 1.0% copper, less than or equal to 0.12% niobium, less than 0.5% molybdenum, between 0.5% and 1.5% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. and above Ara temperature at a cooling rate greater than 15° C./s before rapidly cooling; (c) high friction rolling the thin cast steel strip to a hot rolled thickness of between a 15% and 50% reduction of the as cast thickness producing a hot rolled steel strip free of prior-austenite grain boundary depressions; (d) rapidly cooling to form a steel sheet with a microstructure having by volume at least 75% martensite or at least 75% martensite plus bainite, a yield strength of between 700 and 1600 MPa, a tensile strength of between 1000 and 2100 MPa and an elongation of between 1% and 10%; and (e) surface homogenizing the high friction hot rolled steel strip producing a high friction hot rolled steel strip having a pair of opposing high friction hot rolled homogenized surfaces free of the smear pattern. Here and elsewhere in this disclosure elongation means total elongation. "Rapidly cooling" means to cool at a rate of more than 100° C./s to between 100 and 200° C. Rapidly cooling the present compositions, with an addition of nickel, achieves up to more than 95% martensitic phase steel strip. In one example, rapidly cooling forms a steel sheet with a microstructure having by volume at least 95% martensite or at least 95% martensite plus bainite. The addition of nickel must be sufficient enough to shift the 'peritectic point' away from the carbon region that would otherwise be present in the same composition without the addition of nickel. Specifically, the inclusion of nickel in the composition is believed to contribute to the shifting of the peritectic point away from the carbon region and/or increases a transition temperature of the peritectic point of the composition, which appears to inhibit defects and results in a high strength martensitic steel sheet that is defect free.

Additional variations of the examples of a high friction rolled high strength martensitic steel follow. In some examples, the steel strip may comprise a pair of opposing high friction hot rolled homogenized surfaces substantially free of prior austenite grain boundary depressions and smear pattern. In yet another example, the steel strip may further comprise a pair of opposing high friction hot rolled homogenized surfaces primarily free of prior austenite grain boundary depressions and a smear pattern. In each of these examples, the surfaces may have a surface roughness (Ra) that is not more than 2.5 μm.

In some examples the thin steel strip may be further tempered at a temperature between 150° C. and 250° C. for between 2 and 6 hours. Tempering the steel strip provides improved elongation with minimal loss in strength. For example, a steel strip having a yield strength of 1250 MPa, tensile strength of 1600 MPa and an elongation of 2% was improved to a yield strength of 1250 MPa, tensile strength of 1525 MPa and an elongation of 5% following tempering as described herein.

The steel strip may further comprise by weight greater than 0.005% niobium or greater than 0.01% or 0.02% niobium. The steel strip may comprise by weight greater than 0.05% molybdenum or greater than 0.1% or 0.2% molybdenum. The steel strip may be silicon killed containing by weight less than 0.008% aluminum or less than 0.006% aluminum. The molten melt may have a free oxygen content between 5 to 70 ppm. The steel strip may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel strip less than 2.5 mm in thickness, and cooled in a non-oxidizing atmosphere to below 1080° C. and above Ara temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel strip may come from an austenite grain size of greater than 100 μm. In other embodiments, the martensite in the steel strip may come from an austenite grain size of greater than 150 μm. Rapid solidification at heat fluxes greater than 10 $MW/m^2$ enables the production of an austenite grain size that is responsive to controlled cooling after subsequent hot rolling to enable the production of a defect free strip.

Hot-Stamped Ultra-High Strength Weathering Steel and Hot-Stamped Products

A light-gauge, ultra-high strength weathering steel may be relied on for use in hot-stamping applications and for making hot-stamped products. Generally, steel sheets relied on for use in hot-stamping applications are of stainless-steel compositions or require an additional coating such as, for example, aluminum-silicon coating, zinc-aluminum coating, or the like. The coatings relied on in these steels are for (1) avoiding oxidation upon reheating; (2) providing corrosion protection during service life of the product; and/or (3) to reduce or eliminate decarburization at the surface. More generally stated, the composition and/or coatings of the prior art hot-stamping steel sheets are relied on to maintain high-strength properties and favorable surface structure characteristics. Additionally, the prior art hot-stamping steel sheets also achieve their strength properties, or hardness, from a microstructure influenced by boron. In such hot-stamping application an additional coating is desired while maintaining high-strength properties and favorable surface structure characteristics. The present light-gauge, ultra-high strength weathering steels have achieved the desired properties without relying on stainless steel compositions or otherwise providing an additional coating. Instead, the present light-gauge, ultra-high strength weathering steel compositions rely on a mixture of nickel, chromium, and/or copper, as illustrated in the various examples above and below, for improved corrosion resistance such as, for example, providing a corrosion index of 6.0 or greater independent of any additional coating. Table 3, below, illustrates the properties of a light-gauge, ultra-high strength weathering steel sheet, that was further high friction rolled and undergone an austenitized condition with subsequent quenching. The examples of Table 3 illustrate properties maintained above a minimum tensile strength of 1500 MPa, a minimum yield strength of 1100 MPa, and a minimum elongation of 3% found in a hot-stamping product after having undergone the hot-stamping application.

TABLE 3

| Austenitizing Condition | Tensile Strength (MPa) | Yield Strength (MPa) | Elongation (%) |
|---|---|---|---|
| 900° C., 6 minutes | 1546.98 | 1155.06 | 7.3 |
| 900° C., 6 minutes | 1576.65 | 1154.37 | 7.0 |
| 900° C., 10 minutes | 1591.14 | 1168.86 | 6.4 |
| 900° C., 10 minutes | 1578.03 | 1152.30 | 6.6 |
| 930° C., 6 minutes | 1566.30 | 1146.09 | 7.3 |
| 930° C., 6 minutes | 1566.99 | 1178.52 | 6.5 |
| 930° C., 10 minutes | 1509.03 | 1109.52 | 6.6 |
| 930° C., 10 minutes | 1521.45 | 1129.53 | 6.4 |

In these examples, the steel sheet provided for use in such a hot-stamping application may comprise a composition, characteristics, properties, and/or may have undergone any combination of the processes of any one of the examples of the steel sheets disclosed above, but, is a steel sheet which that is slowly cooled. Specifically, a steel sheet provided for use in a hot-stamping application may be made by the steps comprising: (a) preparing a molten steel melt comprising: (i) by weight, between 0.20% and 0.40% carbon, between 0.1% and 3.0% chromium, between 0.7% and 2.0% manganese, between 0.10% and 0.50% silicon, between 0.1% and 1.0% copper, less than or equal to 0.12% niobium, less than 0.5% molybdenum, between 0.1% and 3.0% nickel, and silicon killed containing less than 0.01% aluminum, and (ii) the remainder iron and impurities resulting from melting; (b) solidifying at a heat flux greater than 10.0 $MW/m^2$ into a steel sheet less than or equal to 2.5 mm in thickness and cooling the sheet in a non-oxidizing atmosphere to below 1080° C. or 1100° C. and above Ara temperature at a cooling rate greater than 15° C./s before cooling; (c) hot rolling the thin cast steel strip to a hot rolled thickness of between a 15% and 35% or 15% and 50% reduction of the as cast thickness; and (d) cooling at less than 100° C./s to form a steel sheet having a microstructure of bainite or martensite, primarily bainite, or substantially bainite. In other words, a steel sheet provided for use in a hot-stamping application may be any one of the examples of the steel sheets disclosed above with the exception that the steel sheet is not rapidly cooled and, thereby, having a microstructure that is primarily or substantially bainite, primarily or substantially martensite, or martensite plus bainite as a result of being slowly cooled. Specifically, the steel sheet provided for use in a hot-stamping application is slowly cooled at less than 100° C./s. In some examples, the above thin cast steel strip may have between 1.0% and 3.0% nickel. In another example, the above thin cast steel strip may have between 2.0% and 3.0% nickel. In examples of the above the thin cast steel strip may have between 0.2% and 0.39% copper. In examples of the above, the thin cast steel strip may have between 0.1% and 1.0% chromium. In examples of the above, the thin cast steel strip may have less than 1.0% chromium. In examples of the above, as discussed below, hot rolling may be high friction hot rolling to produce a hot rolled steel strip primarily free, substantially free, or free of prior austenite grain boundary depressions and having a smear pattern.

Slowly cooling the steel strip in the method above is being done as an alternative to rapidly cooling, or rapidly quenching, as described with respect the martensitic ultra-high strength weathering steel strip described elsewhere in the present disclosure. "Rapidly cooling" means to cool at a rate of more than 100° C./s to between 100 and 200° C. In contrast, slowly cooling the steel strip achieves up to more than 50% and, in some examples, more than 90% bainitic microstructure suitable for hot-stamping. Slowly cooling the thin cast steel strip is done at less than 100° C./s.

In both the rapidly cooled and the slowly cooled microstructures, the addition of nickel must be sufficient enough to shift the 'peritectic point' away from the carbon region that would otherwise be present in the same composition without the addition of nickel. Specifically, the inclusion of nickel in the composition is believed to contribute to the shifting of the peritectic point away from the carbon region and/or increases a transition temperature of the peritectic point of the composition, which appears to inhibit defects and results in a high strength steel sheet that is defect free. In one example, the desired properties may be achieved through nickel, alone, and the above composition may comprise, by weight, less than 1.0% chromium. When chromium is relied on, such as at the higher range in the examples of between 0.1% and 3.0% chromium, the addition of chromium shifts the 'peritectic point' to the carbon region while the addition of nickel shifts the 'peritectic point' away from the carbon region. Thereby, an increased quantity of chromium requires a correspondingly increased quantity of nickel, or vice versa.

As noted above, copper may be additionally, or alternatively, be added to further improve the corrosion index to achieve a weathering steel in combination with, or as an alternative to, the nickel. Like nickel, copper may be relied on to shift the 'peritectic point' away from the carbon region when added, by weight percent, between 0.20% and 0.39%. Thereby, the copper quantity noted by the compositions recited herein may be modified by, weight percent, between 0.20% and 0.39% in an effort to support achieving a weathering steel having a corrosion index of 6.0 or greater in addition to the previously recited nickel quantity. Further, this addition of copper may be relied on as an alternative to nickel, thereby, the compositions recited herein may be modified with the addition of the aforementioned copper while additionally eliminating previously recited nickel. Stated differently, copper may be added in quantity levels higher than that found in scrap material in addition to or as an alternative to nickel to further assist in achieving a weathering steel having corrosion index of 6.0 or greater. Copper of the quantity in excess of 0.39% will have the opposite effect and will, instead, negatively impact the weathering characteristics when provided in excess of this quantity. In these examples, nickel may be relied on in combination with copper to offset such a negative impact. Specific examples are provided in FIG. 4 and illustrate this dynamic in the ultra-high strength weathering steel disclosed herein. The corrosion index of 6.0 or greater of the thin cast steel strip is maintained through subsequent processing such as, for example, austenitizing, quenching upon austenitizing, batch annealing, hot-stamping, cold rolling, hot rolling, high friction rolling, shot blasting, surface homogenizing, oxidizing, coating, or the like.

Table 4, below, provides specific examples of the compositional characteristics and resulting microstructure illustrating the dynamic of the materials in an ultra-high strength weathering steel that may be relied on for hot-stamping applications.

TABLE 4

| | Example 1 | Example 2 | Example 3 | Example 4 |
|---|---|---|---|---|
| % C | 0.23 | 0.23 | 0.23 | 0.23 |
| % Si | 0.2 | 0.2 | 0.2 | 0.2 |
| % Mn | 1 | 1 | 1.2 | 1 |

TABLE 4-continued

| | Example 1 | Example 2 | Example 3 | Example 4 |
|---|---|---|---|---|
| % P | 0.019 | 0.019 | 0.019 | 0.019 |
| % S | 0.03 | 0.03 | 0.03 | 0.03 |
| % Cu | 0.45 | 0.4 | 0.38 | 0.4 |
| % Ni | 2.2 | 0.3 | 0.15 | 0.8 |
| % Cr | 3 | 0.2 | 0.15 | 1 |
| % Mo | 0.02 | 0.02 | 0.02 | 0.02 |
| % W | 0 | 0 | 0 | 0 |
| % Ti | 0 | 0 | 0 | 0 |
| % Co | 0 | 0 | 0 | 0 |
| % N | 0.005 | 0.005 | 0.005 | 0.005 |
| Corrosion Index | 10.107865 | 6.16525 | 6.009139 | 7.5208 |
| Micro-structure | Martensitic | Bainitic | Bainitic | Martensitic + Bainitic |

As illustrated here, slowly cooling may additionally, or alternatively, produce a martensitic microstructure. Austenitizing, as a part of the hot-stamping application, will provide for the requisite austenite, regardless of whether it is a bainitie, martensitic, or martnsitic+bainitic microstructure. This material may then be relied on for hot stamping applications where the material is further heated and cooled during this hot stamping process to produce a martensitic microstructure that is present in a hot stamped product. The subsequent heating (e.g. austenitizing) and cooling (e.g. quenching) that occurs as a part of hot stamping application additionally increases the strength properties of the present thin cast steel strip as illustrated hot stamped product properties illustrated by Table 3, above. This is in contrast to the strength properties of a thin cast steel strip that may subsequently be relied on for use in hot stamping applications. In other words, the thin cast steel strip, as disclosed herein, has not yet undergone these additional hot stamping application steps unless explicitly stated. The subsequent heating and cooling that occurs as a part of the hot stamping application should not be confused with hot rolling, high friction hot rolling, rapidly cooling and/or slowly cooling as relied on for the present thin cast steel strip to provide the ultra-high strength weathering steel with a corrosion index of 6.0 or greater. These weathering steel characteristics (e.g. the corrosion index of 6.0 or greater) are additionally maintained throughout the subsequent hot stamping processes and hot stamping application and are ultimately found in the hot-stamped product, thereby, distinguishing the present thin cast steel strip and resulting hot-stamped product from prior hot-stamping products and prior materials relied on for hot-stamping applications.

Carbon levels in the present sheet steel are preferably not below 0.20% in order to inhibit peritectic cracking of the steel sheet. The addition of nickel is provided to further inhibit peritectic cracking of the steel sheet, but does so independent of relying on the carbon composition alone. The impact of nickel on the corrosion index is reflected in the following equation for determining the corrosion index calculation: Cu*26.01+Ni*3.88+Cr*1.2+Si*1.49+P*17.28−Cu*Ni*7.29−Ni*P*9.1−Cu*Cu*33.39 (where each element is a by weight percentage).

Due to slowly cooling, the hot-stamped product formed from a light-gauge, ultra-high strength weathering steel may have bainite formed from prior austenite. The bainite may be formed from the prior austenite within the thin cast steel strip by cooling the thin cast steel strip at less than 100° C./s. The microstructure of the thin cast steel strip may be primarily bainite. As used herein, primarily bainite refers to a microstructure of 50% or more bainite. In another example, the microstructure of the thin cast steel strip may be substantially bainite. As used herein, substantially bainite refers to a microstructure of 90% or more bainite. The thin cast steel strip may further comprise a yield strength of between 620 and 800 MPa, a tensile strength of between 650 and 900 MPa, and an elongation of between 3% and 10%, or any other variation described with respect to the above methods and products as well as described herein. Much higher strength properties are present in the instance the microstructure of the thin cast steel strip possesses a martensitic microstructure. In such an example, the thin cast steels strip may comprise a yield strength of between 620 and 1100 MPa, a tensile strength of between 650 and 1300 MPa, and an elongation of between 3% and 10%.

As noted above, the light-gauge, ultra-high strength weathering steel sheet for hot-stamping applications may undergo additional processes for further modification of or improvement of properties. An example may include an austenitizing condition at between 780° C. and 950° C. for a period of between 6 minutes and 10 minutes. In another example, the light-gauge, ultra-high strength weathering steel sheet may undergo an austenitizing condition at between 780° C. and 950° C. for a period of 6 minutes. In some examples, the step of austenitizing may be performed between 850° C.-950° C., 900° C.-930° C., or 900° C.-950° C. at a period of between 1 minute and 30 minutes or a period of between 6 minutes and 10 minutes. In specific examples, the light-gauge, ultra-high strength steel sheet undergoes an austenitizing condition at 900° C. for a period of 6 minutes or 10 minutes. In other specific examples, the high friction rolled steel sheet undergoes an austenitizing condition at 930° C. for a period of 6 minutes or 10 minutes. Prior austenitized steel compositions are known to produce an undesirable surface having scales not suitable for the surface characteristics or properties required in hot-stamping applications. Due to the composition, microstructure, the reduced austenitized temperature, and the reduced austenitized period of the thin cast steel strip of the present disclosure, the thin cast steel strip remains substantially free of scale after the step of austenitizing. Substantially free of scale, as used herein, refers to scale formation of less than 1.5 μm thick on the surface of a thin cast steel strip. Scale, as referred to herein, is oxidation or an oxidation layer formed during the austenitizing step. It is appreciated herein that oxidation may be provided on hot-stamped steels to provide a protective layer or as a coating. However, as emphasized in the present disclosure the ultra-high strength weathering steel is a material that possesses the necessary properties for use in hot-stamping applications without adding an oxidation layer or coating. It is also appreciated herein that oxidation layers or coatings may be added to the disclosed ultra-high strength weathering steel but this does not form a part of the discussion with respect to the material properties for a thin cast steel strip, and more specifically, one being substantially free of scale as a result of austenitizing. In other words, because the thin cast steel strip remains free of scale, or free of an oxidization layer while maintaining weathering characteristics (e.g. a corrosion index of at least 6.0), the thin cast steel strip is a steel sheet suitable for hot-stamping application, independent of further surface treatment such as, for example, surface homogenization, shot blasting, coating, or the like, albeit these additional treatments may be provided for alternative purposes as noted herein.

Figure 10:
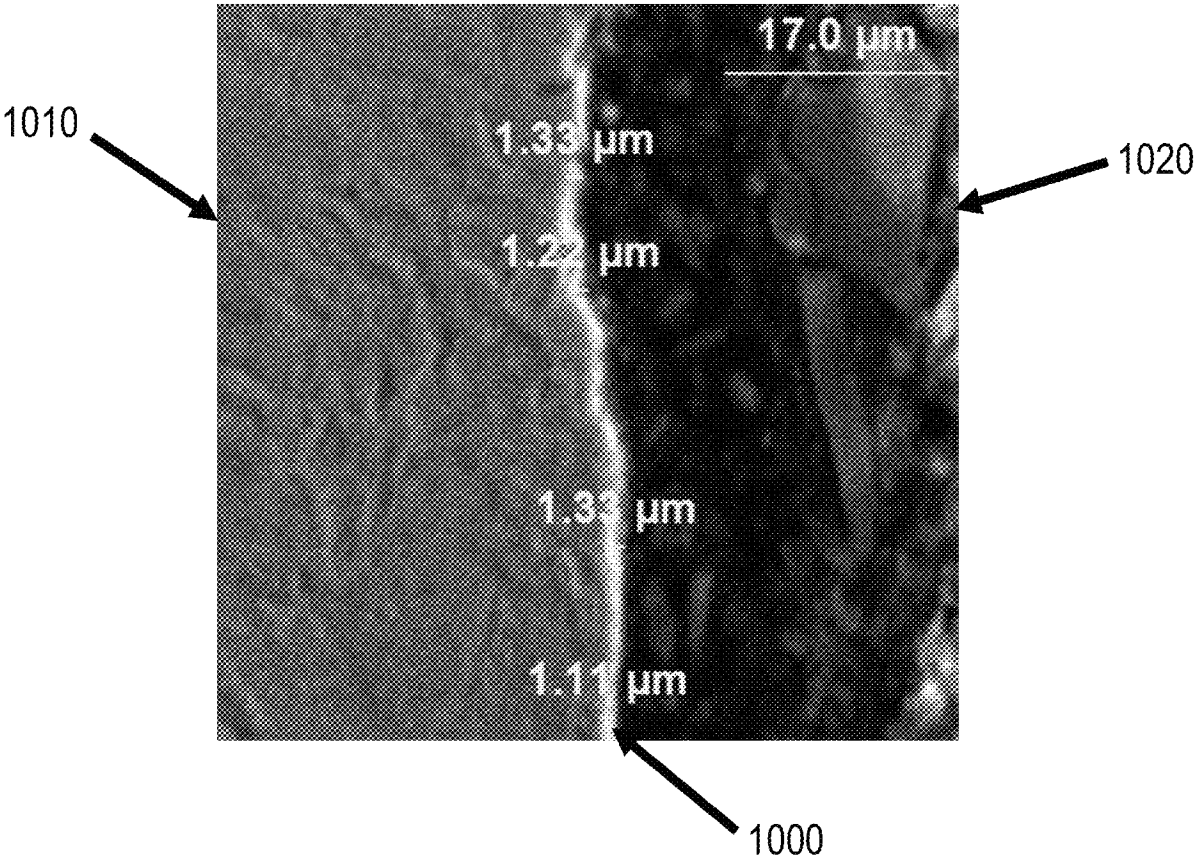
FIG. 10 is an image of an ultra-high strength weathering steel sheet for hot-stamping applications that is substantially free of scale.

FIG. 10 is an image of an ultra-high strength weathering steel sheet of the present disclosure that is substantially free of scale. Specifically, the image is labeled with a measure of the scale 1000, or oxide layer, on the surface of an ultra-high strength weathering steel sheet 1010 as described herein. The scale 1000, or oxide layer, has a thickness of 1.11 μm, 1.22 μm, and 1.33 μm at locations on the surface of the steel sheet. In other words, FIG. 10 illustrates a scale formation of less than 1.5 μm thick. To the left of the scale 1000, or oxide layer, is the steel sheet 1010 having the scale 1000 formed thereon. To the right of the scale 1000, or oxide layer, is a mounting apparatus 1020 holding the steel sheet 1010 for taking the unit of measure. The mounting apparatus 1020 does not form a part of the present invention.

The above methods for making a hot-stamped product from a light-gauge, ultra-high strength weathering steel sheet may further comprise the step of batch annealing the thin cast steel strip to reduce the strength properties and, thereby, the hardness of the thin cast steel strip. It has been found that the light-gauge, ultra-high strength weathering steel sheet possess strength properties greater than prior materials relied on for hot-stamping applications (e.g. 300-600 MPa) and, thereby, may increase the wear on the punching equipment during metal stamping. A softer thin cast steel strip may be desired for such hot-stamping applications wherein this additional step of batch annealing may be undertaken to provide a reduction in the tensile strength and/or yield strength to these desired properties. Batch annealing facilitates bainite grain coarsening, iron-carbide formation, and/or formation of softer ferrite phase to reduce the strength. In one example, the tensile strength of a slowly cooled ultra-high strength weathering steel sheet was reduced from 815 MPa to 730 MPa and the yield strength decreased from 660 MPa to 450 MPa after batch annealing at 800° C. for 20 minutes while maintaining the weathering characteristics (e.g. corrosion index of at least 6.0 where the corrosion index is independent of any additional coating).

Figure 11B:
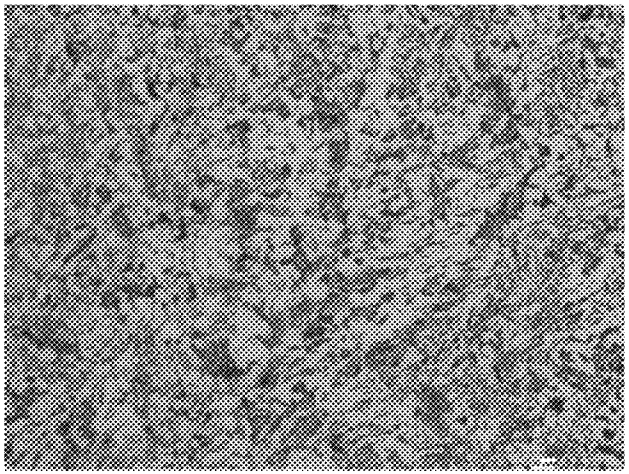
FIG. 11*b* is an image of an ultra-high strength weathering steel sheet for hot-stamping applications that has been batch annealed.
Figure 11A:
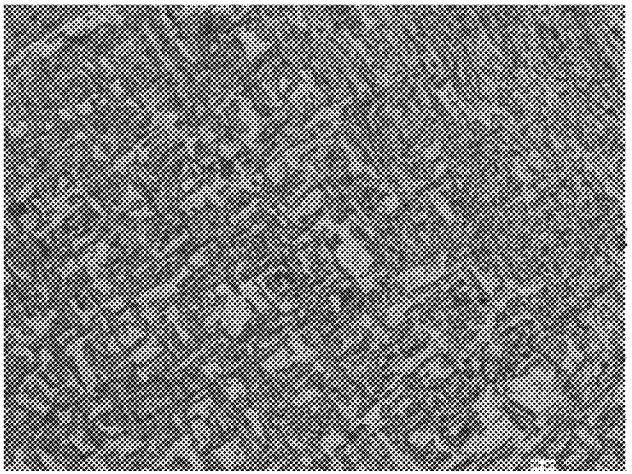
FIG. 11*a* is an image of an ultra-high strength weathering steel sheet for hot-stamping applications that has not been batch annealed.

FIGS. 11*a* and 11*b* are images providing comparative examples of a slowly cooled ultra-high strength weathering steel sheet before and after being batch annealed. In FIG. 11*a* an image of a slowly cooled ultra-high strength weathering steel sheet, that has not been batch annealing, is provided. The slowly cooled ultra-high strength weathering steel sheet that has not been batch annealed has a fine bainite microstructure. In FIG. 11*b* an image of the same slowly cooled ultra-high strength weathering steel sheet is illustrated after having been batch annealed at 800° C. for 20 minutes. As illustrated by FIG. 11*b* the slowly cooled ultra-high strength weathering steel sheet that has been batch annealed has a coarser bainite, carbine, and ferrite microstructure.

As noted above, a high friction hot rolled steel sheet may be provided for use in hot-stamping applications. In one example, the thin cast steel strip may be high friction rolled to a reduced thickness of between 15% and 35% reduction before the step of cooling. In another example, the thin cast steel strip may be high friction rolled to between 15% and 50% reduction before the step of cooling. Stated differently, in some examples of the above, the thin cast steel strip may be high friction rolled before forming the bainite. In one example, the thin cast steel strip may be high friction rolled to a reduced thickness of between 15% and 35% reduction before forming the bainite. In another example, the thin cast steel strip may be high friction rolled to between 15% and 50% reduction before forming the bainite.

High friction rolling provides a pair of opposing exterior side surfaces of the thin cast steel strip that are primarily free of prior austenite grain boundaries. In another example, high friction rolling may provide a pair of opposing exterior side surfaces of the thin cast steel strip that are substantially free of prior austenite grain boundaries. In yet another example, high friction rolling may provide a pair of opposing exterior side surfaces of the thin cast steel strip that are free of prior austenite grain boundaries. The pair of opposing exterior side surface of the thin cast steel strip may further comprise a smear pattern formed from high friction hot rolling the prior austenite grain boundaries. The smear patterns may extend in the direction of rolling.

In contrast to prior steel sheets typically relied on for hot-stamping applications and products, the above methods and materials for making a hot-stamped product from a light-gauge, ultra-high strength weathering steel sheet is achieved in a thin cast steel strip with a composition having no purposeful addition of boron. In one example, the thin cast steel strip is formed with less than 5 ppm boron. The hot-stamped products from the above-mentioned light-gauge, ultra-high strength weathering steel sheet are further distinguished from prior hot-stamped steel materials and products such that it may be uncoated by a corrosion resistant coating typically found on prior hot-stamped steel materials and products. Alternatively, the hot-stamped products from the above-mentioned light-gauge, ultra-high strength weathering steel sheet may be coated by a corrosion resistant coating for further improved properties.

The hot-stamped product formed from a light-gauge, ultra-high strength weathering steel having a corrosion index of 6.0 or greater. The corrosion index of 6.0 or greater is independent of any additional coating. The corrosion index may be independent of or a result of the thin cast steel strip further undergoing an austenitizing conditions noted above.

Hot Rolling, Including Low Friction Hot Rolling and High Friction Hot Rolling

Hot rolling and, more specifically, low friction rolling and high friction rolling, as relied on in the above examples of the present disclosure, is further described below. The concepts as described below may be applied to the examples provided above as necessary to achieve the properties of each respective example. Generally, in each of the hot rolled examples, the strip is passed through the hot mill to reduce the as-cast thickness before the strip is cooled, such as to a temperature at which austenite in the steel transforms to martensite in particular embodiments. In particular instances, the hot solidified strip (the cast strip) may be passed through the hot mill while at an entry temperature greater than 1050° C., and in certain instances up to 1150° C. After the strip exits the hot mill, the strip is cooled such as, in certain exemplary instances, to a temperature at which the austenite in the steel transforms to martensite by cooling to a temperature equal to or less than the martensite start transformation temperature Ms. In certain instances, this temperature is <600° C., where the martensite start transformation temperature $M_S$ is dependent on the particular composition. Cooling may be achieved by any known methods using any known mechanism(s), including those described above. In certain instances, the cooling is sufficiently rapid to avoid the onset of appreciable ferrite, which is also influenced by composition. In such instances, for example, the cooling is configured to reduce the temperature of the strip at the rate of about 100° C. to 200° C. per second.

Hot rolling is performed using one or more pairs of opposing work rolls. Work rolls are commonly employed to reduce the thickness of a substrate, such as a plate or strip. This is achieved by passing the substrate through a gap arranged between the pair of work rolls, the gap being less than the thickness of the substrate. The gap is also referred to as a roll bite. During hot working, a force is applied to the substrate by the work rolls, thereby applying a rolling force on the substrate to thereby achieve a desired reduction in the substrate thickness. In doing so, friction is generated between the substrate and each work roll as the substrate translates through the gap. This friction is referred to as roll bite friction.

Traditionally, the desire is to reduce the bite friction during hot rolling of steel plates and strips. By reducing the bite friction (and therefore the friction coefficient), the rolling load and roll wear are reduced to extend the life of the machine. Various techniques have been employed to reduce roll bite friction and the coefficient of friction. In certain exemplary instances, the thin steel strip is lubricated to reduce the roll bite friction. Lubrication may take the form of oil, which is applied to rolls and/or thin steel strip, or of oxidation scale formed along the exterior of the thin steel strip prior to hot rolling. By employing lubrication, hot rolling may occur in a low friction condition, where the coefficient of friction (p) for the roll bite is less than 0.20.

Figure 8:
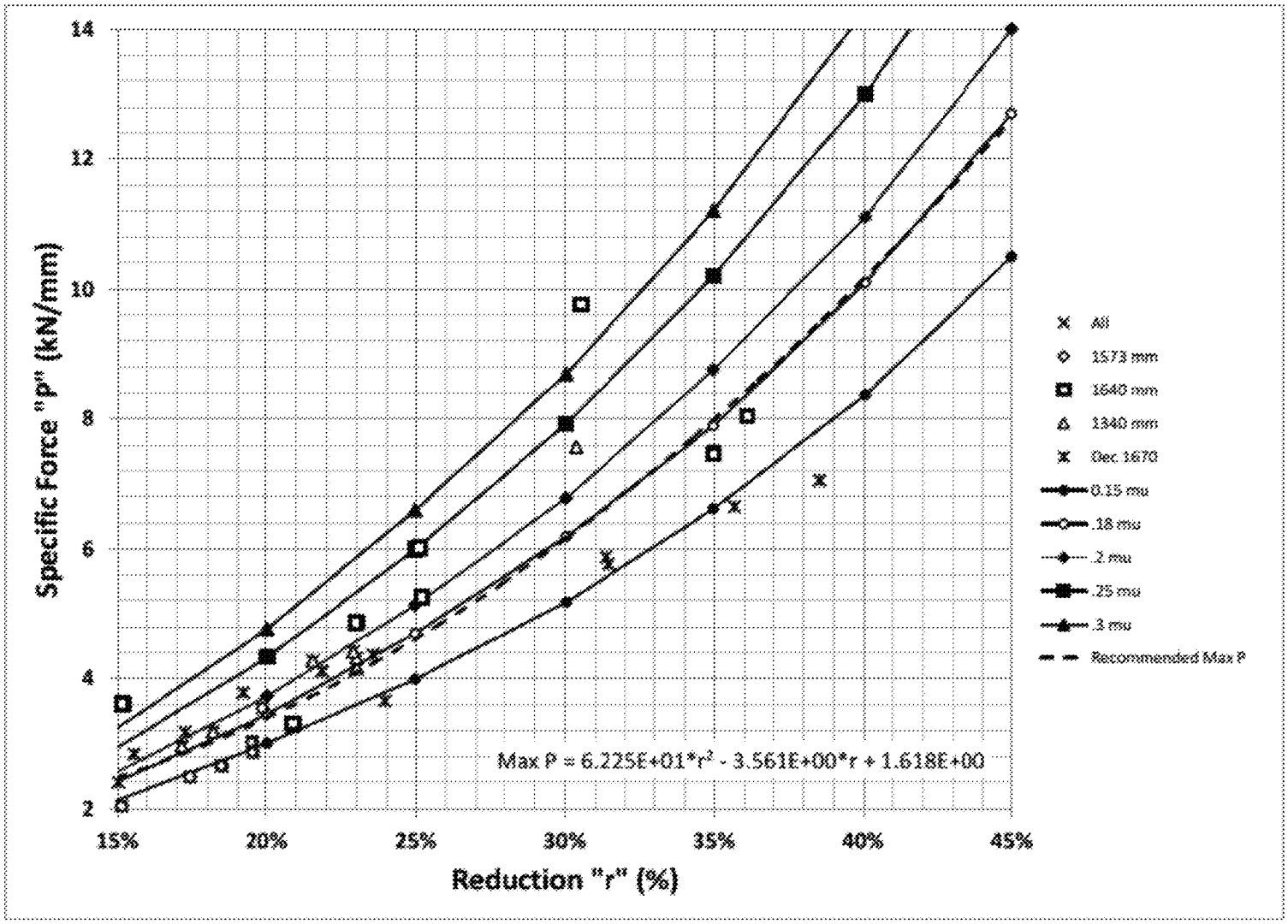
FIG. 8 is a coefficient of friction model chart created to determine the coefficient of friction for a particular pair of work rolls, specific mill force, and corresponding reduction.

In one example, the friction coefficient (p) is determined based upon a hot rolling model developed by HATCH for a particular set of work rolls. The model is shown in FIG. 8, providing thin steel strip thickness reduction in percent along the X-axis and the specific force "P" in kN/mm along the Y-axis. The specific force P is the normal (vertical) force applied to the substrate by the work rolls. The model includes five (5) curves each representing a coefficient of friction and providing a relationship between reduction and work roll forces. For each coefficient of friction, expected work roll forces are obtained based upon the measured reduction. In operation, during hot rolling, the targeted coefficient of friction is preset by adjustment of work roll lubrication, the target reduction is set by the desired strip thickness required at the mill exit to meet a specific customer order and the actual work roll force will be adjusted to achieve the target reduction. FIG. 8 shows typical forces required to achieve a target reduction for a specific coefficient of friction.

In certain exemplary instances, the coefficient of friction is equal to or greater than 0.20. In other exemplary instances, the coefficient of friction is equal to or greater than 0.25, equal to or greater than 0.268 or equal to or greater than 0.27. It is appreciated that these friction coefficients are sufficient, under certain conditions for austenitic steel (which is the steel alloy employed in the examples shown in the figures), where during hot rolling, the steel is austenitic but after cooling martensite is formed having prior austenite grains and prior austenite grain boundary depressions present, to at least primarily or substantially eliminate prior austenite grain boundary depressions from hot rolled surfaces and to generate elongated surface features plastically formed by shear. As noted previously, various factors or parameters may be altered to attain a desired coefficient of friction under certain conditions. It is noted that for the coefficient of friction values previously described, for substrates having a thickness of 5 mm or less prior to hot rolling the normal force applied to the substrate during hot rolling may be 600 to 2500 tons while the substrate and enters the pair of work rolls and translates, or advances, at a rate of 45 to 75 meters per minute (m/min) where the temperature of the substrate entering the work rolls is greater than 1050° C., and in certain instances, up to 1150° C. For these coefficients of friction, the work rolls have a diameter of 400 to 600 mm. Of course, variations outside each of these parameter ranges may be employed as desired to attain different coefficients of friction as may be desired to achieve the hot rolled surface characteristics described herein.

In one example, hot rolling is performed under a high friction condition with a coefficient of friction of 0.25 at 60 meters per minute (m/min) at a reduction of 22% with a work roll force of approximately 820 tons. In another example, hot rolling is performed under a high friction condition with a coefficient of friction of 0.27 at 60 meters per minute (m/min) at a reduction of 22% with a work roll force of approximately 900 tons.

Figure 9:
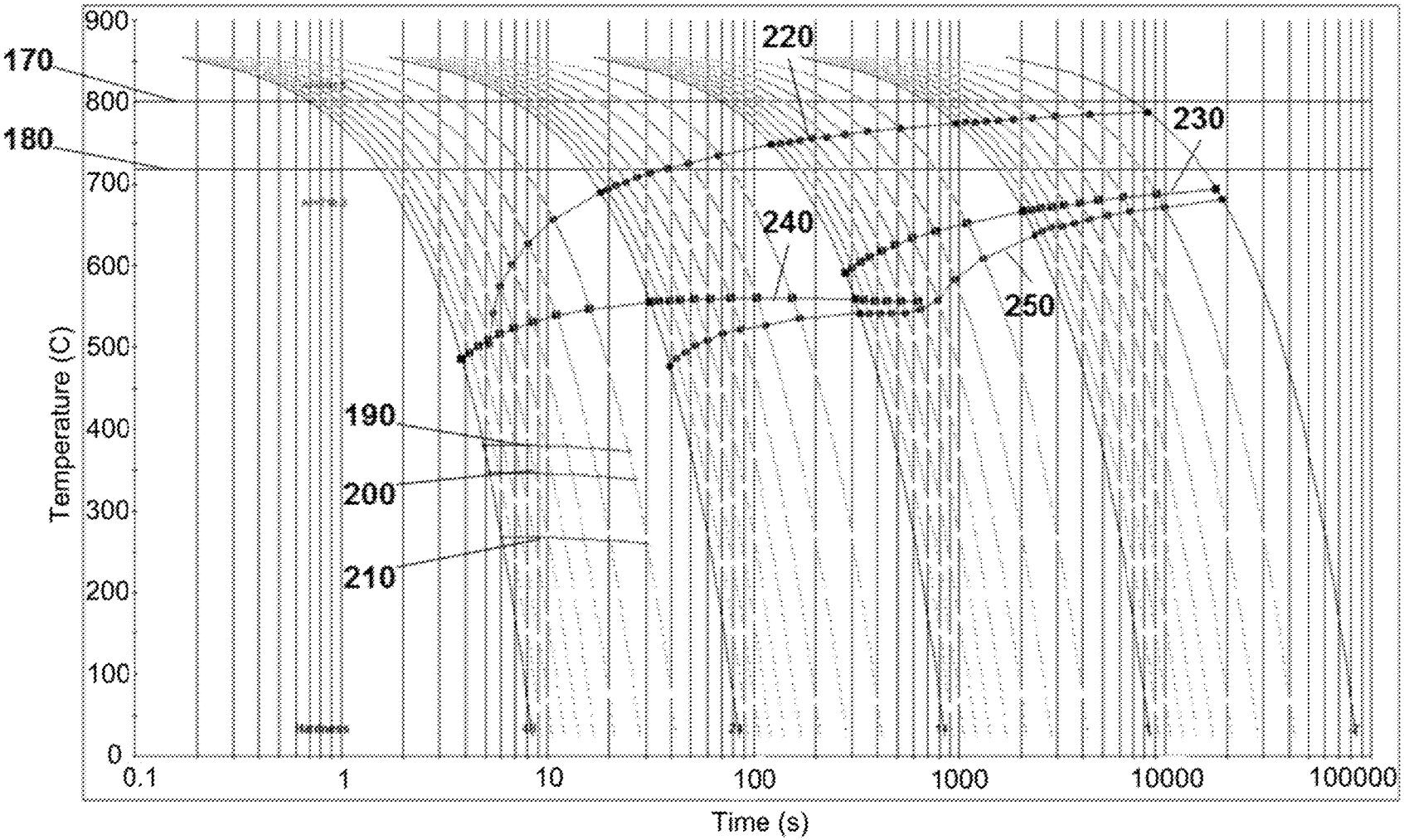
FIG. 9 is a continuous cool transformation (CCT) diagram for steel.

As relied on in the examples of the present disclosure, hot rolling of the thin steel strip is performed while the thin steel strip is at a temperature above the $Ar_3$ temperature. The $Ar_3$ temperature is the temperature at which austenite begins to transform to ferrite during cooling. In other words, the $Ar_3$ temperature is the point of austenite transformation. The $Ar_3$ temperature is located a few degrees below the $A_3$ temperature. Below the $Ar_3$ temperature, alpha ferrite forms. These temperatures are shown in an exemplary CCT diagram in FIG. 9. In FIG. 9, $A_3$ 170 represents the upper temperature for the end of stability for ferrite in equilibrium. $Ar_3$ is the upper limit temperature for the end of stability for ferrite on cooling. More specifically, The $Ar_3$ temperature is the temperature at which austenite begins to transform to ferrite during cooling. In other words, the $Ar_3$ temperature is the point of austenite transformation. Comparatively, $A_1$ 180 represents the lower limit temperature for the end of stability for ferrite in equilibrium.

Still referring to FIG. 9, the ferrite curve 220 represents the transformation temperature producing a microstructure of 1% ferrite, the pearlite curve 230 represents the transformation temperature producing a microstructure of 1% pearlite, the austenite curve 250 represents the transformation temperature producing a microstructure of 1% austenite, and the bainite curve ($B_s$) 240 represents the transformation temperature producing a microstructure of 1% bainite. As previously described in greater detail, a martensite start transformation temperature $M_S$ is represented by the martensite curve 190 where martensite begins forming from prior austenite within the thin steel strip. Further illustrated by FIG. 9 is a 50% martensite curve 200 representing a microstructure having at least 50% martensite. Additionally, FIG. 9 illustrates a 90% martensite curve 210 representing a microstructure having at least 90% martensite.

In the exemplary CCT diagram shown in FIG. 9, the martensite start transformation temperature $M_S$ 190 is shown. In passing through the cooler, the austenite in the strip is transformed to martensite. Specifically, in this instance, cooling the strip to below 600° C. causes a transformation of the coarse austenite wherein a distribution of fine iron carbides are precipitated within the martensite.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A continuously cast ultra-high strength steel sheet with a corrosion resistance of a weathering steel for use in hot-stamping applications comprising:

a carbon alloy thin cast steel strip cast at a cast thickness less than or equal to 2.5 mm having a composition comprising:

(i) by weight, between 0.20% and 0.40% carbon, between 0.1% and 3.0% chromium, between 0.7% and 2.0% manganese, between 0.10% and 0.50% silicon, between 0.1% and 1.0% copper, less than or equal to 0.12% niobium, less than 0.5% molybdenum, between 0.1% and 3.0% nickel, and silicon killed containing less than 0.01% aluminum, and (ii) the remainder iron and impurities resulting from melting;

wherein bainite is formed from prior austenite within the thin cast steel strip by cooling the thin cast steel strip at less than 100° C./s to produce a microstructure of primarily bainite, a yield strength of between 620 and 800 MPa, a tensile strength of between 650 and 900 MPa, an elongation of between 3% and 10%, and having a corrosion index of 6.0 or greater independent of an additional coating.

2. The steel sheet of claim 1 wherein bainite is formed from the prior austenite within the thin cast steel strip by cooling the thin cast steel strip at less than 100° C./s to produce a microstructure of substantially bainite.

3. The steel sheet of claim 1 wherein the carbon alloy thin cast steel strip comprises, by weight, between 0.2% and 0.39% copper.

4. The steel sheet of claim 1 wherein the carbon alloy thin cast steel strip comprises, by weight, between 1.0% and 3.0% nickel.

5. The steel sheet of claim 1 wherein the carbon alloy thin cast steel strip comprises, by weight, between 0.2% and 0.39% copper and between 1.0% and 3.0% nickel.

6. The steel sheet of claim 1 wherein the thin cast steel strip is capable of undergoing an austenitizing condition at between 780° C. and 950° C. to austenitize the thin cast steel strip.

7. The steel sheet of claim 6 wherein the austenitizing condition is for a period of between 1 minute and 30 minutes.

8. The steel sheet of claim 6 wherein the austenitizing condition is for a period of between 6 minutes and 10 minutes.

9. The steel sheet of claim 1 wherein the thin cast steel strip is capable of undergoing an austenitizing condition at between 900° C. and 930° C. to austenitize the thin cast steel strip.

10. The steel sheet of claim 9 wherein the austenitizing condition is for a period of between 1 minute and 30 minutes.

11. The steel sheet of claim 9 wherein the austenitizing condition is for a period of between 6 minutes and 10 minutes.

12. The steel sheet of claim 1 wherein the cast thickness is solidified at a heat flux greater than 10.0 $MW/m^2$ and cooled in a non-oxidizing atmosphere to below 1100° C. and above the Ar3 temperature at a cooling rate greater than 15° C./s before the bainite is formed from prior austenite.

13. The steel sheet of claim 1 having a reduced thickness of between 15% and 50% reduction by hot rolling the as-cast thickness before forming the bainite.

14. The steel sheet of claim 1 having a reduced thickness of between 15% and 50% reduction and having a pair of opposing exterior side surfaces primarily free of prior austenite grain boundary depressions by high friction hot rolling the opposing exterior side surfaces before forming the bainite.

15. The steel sheet of claim 14 wherein the pair of opposing exterior side surfaces are substantially free of prior austenite grain boundary depressions by high friction hot rolling the opposing exterior side surfaces before forming bainite.

16. The steel sheet of claim 14 wherein the pair of opposing exterior side surfaces further comprise a smear pattern of prior austenite grain boundaries, the smear pattern formed under shear through plastic deformation from high friction hot rolled prior austenite grain boundaries of the pair of opposing exterior side surfaces, the smear pattern extending in a direction of the high friction hot rolling.

17. The steel sheet of claim 16 wherein the pair of opposing exterior side surfaces are surface homogenized to eliminate the smear pattern.

18. The steel sheet of claim 1 wherein the composition has no purposeful addition of boron.

19. The steel sheet of claim 1 wherein the thin cast steel strip is formed with less than 5 ppm boron.

20. The steel sheet of claim 1 that is uncoated by an additional coating.

21. The steel sheet of claim 1 further comprising an additional coating.

22. The steel sheet of claim 1 comprising, by weight, between 0.1% and 1.0% chromium.

23. The steel sheet of claim 1 that is substantially free of scale when reheated to above an austenitizing temperature.

24. A method for making a hot-stamped product from a continuously cast ultra-high strength steel sheet with a corrosion resistance of a weathering steel comprising the steps of:

(a) preparing a molten steel melt comprising:

(i) by weight, between 0.20% and 0.35% carbon, between 0.1% and 3.0% chromium, between 0.7% and 2.0% manganese, between 0.10% and 0.50% silicon, between 0.1% and 1.0% copper, less than or equal to 0.12% niobium, less than 0.5% molybdenum, between 0.1% and 3.0% nickel, silicon killed with less than 0.01% aluminum, and (ii) the remainder being iron and impurities resulting from melting;

(b) forming the melt into a casting pool supported on casting surfaces of a pair of cooled casting rolls having a nip there between;

(c) counter rotating the casting rolls and solidifying at a heat flux greater than 10.0 $MW/m^2$ into a thin cast steel sheet to less than 2.5 mm in thickness delivered downwardly from the nip and cooling the sheet in a non-oxidizing temperature to below 1100° C. and above the Ar3 temperature at a cooling rate greater than 15° C./s;

(d) slowly cooling the thin cast steel strip at less than 100° C./s to produce a microstructure of primarily bainite from prior austenite within the thin cast steel strip, a yield strength of between 620 and 800 MPa, a tensile strength of between 650 and 900 MPa, an elongation of between 3% and 10%, and having a corrosion index of 6.0 or greater independent of an additional coating; and (e) hot-stamping the thin cast steel strip to austenitize the thin cast steel strip to form a product with a yield strength and a tensile strength in excess of the yield strength and the tensile strength of the thin cast steel strip.

25. The method of claim 24 where the step of cooling the thin cast steel strip at less than 100° C./s forms a product comprising a microstructure of substantially bainite.

26. The method of claim 24 further comprising the step of: austenitizing the thin cast steel strip at between 780° C. and 950° C.

27. The method of claim 26 wherein the step of austenitizing is for a period of between 1 minute and 30 minutes.

28. The method of claim 26 where the step of austenitizing is for a period of between 6 minutes and 10 minutes.

29. The method of claim 24 where the thin cast steel strip is substantially free of scale after the step of austenitizing.

30. The method of claim 24 further comprising the step of: austenitizing the thin cast steel strip at between 900° C. and 930° C.

31. The method of claim 30 wherein the step of austenitizing is for a period of between 1 minute and 30 minutes.

32. The method of claim 30 wherein the step of austenitizing is for a period of between 6 minutes and 10 minutes.

33. The method of claim 24 further comprising the step of: batch annealing the thin cast steel strip to reduce the yield strength to below 600 MPa and reduce the tensile strength to below 750 MPa.

34. The method of claim 24 further comprising the step of: hot rolling the thin cast steel strip to a reduced thickness of between 15% and 50% reduction of the as-cast thickness.

35. The method of claim 24 further comprising the step of: high friction hot rolling the thin cast steel strip to a reduced thickness of between 15% and 50% reduction of the as-cast thickness before forming the bainite to provide a pair of opposing exterior side surfaces of the thin cast steel strip that are primarily free of prior austenite grain boundary depressions.

36. The method of claim 35 wherein the pair of opposing exterior side surfaces are substantially free of prior austenite grain boundaries.

37. The method of claim 35 wherein the pair of opposing exterior side surfaces further comprise a smear pattern formed from high friction hot rolled prior austenite grain boundaries.

38. The method of claim 37 further comprising the step of: surface homogenizing the pair of opposing exterior side surfaces to eliminate the smear pattern.

39. The method of claim 24 wherein the composition has no purposeful addition of boron.

40. The method of claim 24 wherein the thin cast steel strip is formed with less than 5 ppm boron.

41. The method of claim 24 wherein the thin cast steel strip is uncoated by an additional coating.

42. The method of claim 24 further comprising the step of: coating the thin cast steel strip with an additional coating.

43. The method of claim 24 wherein the composition comprises, by weight, between 0.1% and 1.0% chromium.

* * * * *